United States Patent [19]

Hirabayashi et al.

[11] Patent Number: 4,710,453

[45] Date of Patent: Dec. 1, 1987

[54] SILVER HALIDE COLOR PHOTOGRAPHIC MATERIAL

[75] Inventors: Shigeto Hirabayashi; Syoji Matsuzaka, both of Hachioji; Yukio Ohya, Hino; Yoshiyuki Nonaka, Hachioji, all of Japan

[73] Assignee: Konishiroku Photo Industry Co., Ltd., Japan

[21] Appl. No.: 830,180

[22] Filed: Feb. 18, 1986

[30] Foreign Application Priority Data

Feb. 19, 1985 [JP] Japan ..... 60-29452

[51] Int. Cl.[4] ..... G03C 7/36; G03C 7/38

[52] U.S. Cl. ..... 430/505; 430/557; 430/558

[58] Field of Search ..... 430/505, 558 R

[56] References Cited

U.S. PATENT DOCUMENTS

| | | | |
|---|---|---|---|
| 4,548,899 | 10/1985 | Nakayama et al. | 430/558 |
| 4,562,146 | 12/1985 | Masuda et al. | 430/558 |
| 4,600,688 | 7/1986 | Kawakatsu et al. | 430/505 |
| 4,607,002 | 8/1986 | Nakayama et al. | 430/558 |
| 4,623,617 | 11/1986 | Kaneko et al. | 430/558 |

*Primary Examiner*—Richard L. Schilling

*Attorney, Agent, or Firm*—Finnegan, Henderson, Farabow, Garrett & Dunner

[57] ABSTRACT

A silver halide color photographic material is disclosed. Said material has formed on a base photographic layers including a blue-sensitive silver halide emulsion layer, a green-sensitive silver halide emulsion layer and a red-sensitive silver halide emulsion layer, wherein said blue-sensitive silver halide emulsion layer contains at least one highly reactive yellow coupler having a relative coupling reaction rate of 0.3 or more, said green-sensitive silver halide emulsion layer containing at least one compound of Formula (I):

(I)

wherein X is a halogen atom or a monovalent organic group capable of leaving upon coupling reaction with the oxidized product of a developing agent; $R_1$ to $R_3$ which may be the same or different each represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyan group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an aryloxycarbonylamino group, an alkoxycarbonyl group, an aryloxycarbonyl group, an alkylthio group, an arylthio group or a heterocyclic thio group, provided that at least two of $R_1$ to $R_3$ are other than a hydrogen atom; and $R_4$ is a hydrogen atom, an alkyl group, an aryl group, a heterocyclic group, an acylamino group, analkylamino group, an anilino group, an alkoxycarbonyl group or an alkylthio group.

14 Claims, No Drawings

SILVER HALIDE COLOR PHOTOGRAPHIC MATERIAL

FIELD OF THE INVENTION

The present invention relates to a silver halide color photographic material and, more particularly, to a silver halide color photographic material that can be processed rapidly and in a consistent manner using a reduced amount of silver and which has good keeping quality and produces a color image having improved light-fastness.

BACKGROUND OF THE INVENTION

Silver halide color photographic materials commonly employ three different photographic silver halide emulsion layers that are formed on a base and which are spectrally sensitized to have sensitivity to blue, green and red regions of light. For example, in silver halide photographic materials for use as color negatives, a base is coated, in order from the exposure side, with a blue-sensitive silver halide emulsion layer, a green-sensitive silver halide emulsion layer and a red-sensitive silver halide emulsion layer. A bleachable yellow filter layer is disposed between blue- and green-sensitive emulsion layers in order to absorb blue light that has passed through the blue-sensitive emulsion layer. Each of the emulsion layers is provided with other intermediate layers that serve to accomplish various functions, and a protective layer is provided as the outermost coat. In silver halide photographic materials for use as color prints, the base is coated, in order from the exposure side, with red-, green-, and blue-sensitive silver halide emulion layers and, as in the case of silver halide photographic materials for use as color negatives, various intermediate layers such as an ultra-violet absorbing layer, and the protective coat are provided. The aforementioned silver halide emulsion layers may be arranged in orders that are different from those specified above. If desired, each of the silver halide emulsion layers may be a light-sensitive silver halide emulsion layer that is composed of two layers having sensitivity to light in substantially the same wavelength range but which have different degrees of sensitivity. With the silver halide color photographic materials described above, a color developing agent, typically an aromatic primary amino color developing agent, is used to develop exposed silver halide grains and the resulting oxidation product of the color developing agent reacts with a dye forming coupler so as to form a dye image. In this process, a cyan dye image is customarily formed with the aid of a phenolic or naphtholic cyan coupler, a magenta dye image is formed with the aid of a 5-pyrazolone, pyrazolinobenzimidazole, pyrazolotriazole, indazolone or cyanoacetyl based magenta coupler, and a yellow dye image is formed with the aid of an acylacetamide based yellow coupler. These dye forming couplers are incorporated in either the appropriate light-sensitive silver halide emulsion layer or in the developing solution. The present invention relates to a silver halide color photographic material of the type wherein the aforementioned couplers are incorporated in the appropriate silver halide emulsion layers in a non-diffusible form.

The modern photographic industry strongly needs silver halide color photographic materials that can be processed rapidly and in a consistent manner using a reduced amount of silver and having good keeping quality. Among all other thins, rapidly processable silver halide color photographic materials are the goal of all photographic engineers. It is common practice at modern laboratories to process silver halide color photographic materials by running treatment with an automatic developer. In order to meet the consumer's demand for rapid access to the pictures they have taken, the laboratories are required to complete the necessary processing within the day of receipt and to return the film to the customer together with the processed print. In an urgent case, these procedures must be completed within several hours from the time of receipt. A situation therefore exists for providing very rapidly processable silver halide color photographic materials.

Another problem with the running processing of silver halide color photographic materials is that prints with consistent photographic performance cannot be obtained since their photographic characteristics are highly sensitive to any variations in the compositions of the processing solutions and in the processing conditions that will occur between different laboratories or even at the same laboratory. Such variations in the compositions of the processing solutions and in the processing conditions are believed to result principally from the dissolution of photographically active substances out of the photographic material being processed by the running method and from subsequent accumulation of the dissolved substances within the processing solutions. In order to accommodate the variations in the processing conditions, it is required to closely control the time of development, the temperature and pH of the developing solution, as well as the concentrations of halides, especially bromide ions. The fact is, however, that the concentration of bromide ions in the developing solution is difficult to determine quantitatively and, hence, to control precisely as compared with the time of development and the temperature and pH of the developing solution. It is therefore necessary to develop a silver halide color photographic material whose photographic performance is less dependent on the bromide concentration and which can be processed in a highly consistent manner. This requirement is of course important for processing by the conventional scheme but is by far more important for rapid processing purposes. Needless to say, the silver halide color photographic material that can be processed in a consistent manner should also be processed using a reduced amount of silver and must be offered at an economically feasible price. Another inevitable requirement is that such silver halide color photographic material should withstand extended storage without undergoing any impairment of its photographic characteristics.

Several prior art methods have been proposed for producing rapidly processable silver halide color photographic materials; they include (1) preparing very fine silver halide grains as described in Unexamined Published Japanese Patent Application No. 77223/1976; (2) preparing a silver halide composition with a reduced content of silver bromide as shown in Unexamined Published Japanese Patent Application No. 184142/1983 and Japanese Patent Publication No. 18939/1981; and (3) incorporating a 1-aryl-3-pyrazolidone with a specified structure in the silver halide color photographic material as disclosed in Unexamined Published Japanese Patent Application, No. 64339/1981 or incorporating 1-arylpyrazolidones in the silver halide color photographic material as shown in Unexamined Published Japanese Patent Application Nos. 144547/1982, 50534/1983, 50535/1983 and 50536/1983. Also known is the use of a color development accelerator when an exposed silver halide color photographic material is developed with an aromatic primary amino color developing agent. Compounds suitable for use as such color development accelerator are shown in U.S. Pat. Nos. 2,950,970, 2,515,147, 2,496,903, 4,038,075 and 4,119,462; British Pat. Nos. 1,430,998 and 1,455,413; Unexamined Published Japanese Patent Application Nos. 15831/1978; 62450/1980, 62451/1980, 62452/1980, 62453/1980, 12422/1976 and 62453/1980; as well as Japanese Patent Publication Nos. 12422/1976 and 49728/1980.

The methods (3) and (4) are capable of shortening the processing time but they are unable to ensure a high degree of consistency in rapid processing and the processed photographic material will fog within 24 hours. When a silver halide emulsion with a reduced silver bromide content is used in accordance with the method (2), rapid processing is possible since a reduced amount of bromide ions will dissolve into the processing solution from the silver halide color photographic material incorporating said low-silver bromide emulsion. The problem, however, is that only a low degree of consistency is achieved in processing the silver halide color photographic material with the processing solution having a low concentration of bromide ions. The "consistency in processing" is expressed by sensitometric changes resulting from variations in the composition of the processing solution, pH, temperature and the concentration of bromide ions, as well as from the entrance of undesirable compounds into the processing solution.

The method (1) depending on the use of tiny silver halide grains is unable to attain a high degree of consistency in processing and, furthermore, the sensitivity of silver halide grains is deteriorated as they become smaller in size.

As disclosed in Unexamined Published Japanese Patent Patent Application Nos. 121036/1984 and 120250/1984, the degree of consistency in processing is conventionally improved by means of improving the composition of a specific processing solution, but to the best knowledge of the present inventors, no attempt has been made to achieve substantial improvement in the consistency of processing by means of employing a silver halide color photographic material with an improved composition.

As mentioned earlier in this specification, a blue-sensitive silver halide emulsion layer in the silver halide photographic material for use as color paper is disposed closest to the base and has the greatest need for improvement in developability. With a view of enabling rapid processing by means of improving silver halide color photographic materials, the present inventors previously made an attempt at incorporating a highly reactive yellow coupler in the blue-sensitive silver halide emulsion layer and the resulting product did have the capability of rapid processing. However, extensive fogging occurred in this material during rapid processing and the processed material did not have the desired long keeping properties.

On the basis of these findings, the present inventors filed Japanese Patent Application No. 202058/1984 on an improved silver halide color photographic material having blue-, green- and red-sensitive silver halide emulsion layers on a base. The proposed photographic material was characterized in that the blue-sensitive silver halide emulsion layer contained at least one highly reactive yellow coupler having a relative coupling rate of 0.3 or more and that the green-sensitive silver halide emulsion layer contained at least one compound represented by Formula (A):

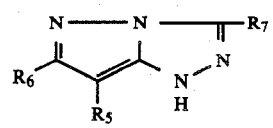

(A)

where $R_5$ is a halogen atom or a monovalent organic group capable of leaving upon coupling reaction with the oxidized product of a developing agent; $R_6$ and $R_7$ which may be the same or different each represents a hydrogen atom, an alkyl group, an aryl group, a heterocyclic group, an acylamino group, an alkylamino group, an anilino group, an alkoxycarbonyl group or an alkylthio group, provided that $R_6$ and $R_7$ are not a hydrogen atom at the same time.

The proposed silver halide color photographic material can be processed rapidly in a consistent manner and without experiencing extensive fogging, and the so processed material has long keeping quality.

The present inventors continued their studies on the above proposed technique and found the following. The magenta dye image forming couplers that are extensively used on a commercial scale and which have constituted the subject of active research work are practically limited to 5-pyrazolones. The dyes formed from the 5-pyrazolone based couplers are highly resistant to heat and light but have an unwanted yellow absorption band at a wavelength in the neighborhood of 430 nm, causing undesirable color contamination. Nuclei of magenta dye image forming couplers that are known to be capable of reducing the unwanted yellow component in the absorption spectrum include the pyrazolobenzimidazole nucleus shown in British Pat. No. 1,047,612, the indazolone nucleus shown in U.S. Pat. No. 3,770,447, and the pyrazolotriazole nucleus disclosed in U.S. Pat. No. 3,725,067. The dye formed from the 1H-pyrazolo[3,2-C]-s-triazole type coupler represented by Formula (A) in accordance with Japanese Patent Application No. 202058/1984 has a smaller degree of the undesirable absorption in the neighborhood of 430 nm within a solvent such as ethyl acetate or dibutyl phthalate, and is further characterized by a minimal absorption tall in the long-wavelength side of the absorption curve. However, the resulting azomethine dye is very low in lightfastness and causes highly deleterious effects on the performance of color photographic materials, especially those for use as color prints.

SUMMARY OF THE INVENTION

The present invention has been accomplished in order to solve the aforementioned problems of the prior art techniques. The principal purpose, therefore, of the present invention is to provide a silver halide color photographic material that can be processed rapidly and in a consistent manner without causing extensive fog, and which has good keeping quality while producing a color image having improved lightfastness.

The above stated object of the present invention can be achieved by a silver halide color photographic material having formed on a base photographic layers including a blue-sensitive silver halide emulsion layer, a green-sensitive silver halide emulsion layer and a red-sensitive silver halide emulsion layer, wherein said blue-sensitive silver halide emulsion layer contains at least one highly reactive yellow coupler having a relative coupling reaction rate of 0.3 or more, said green-sensitive silver halide emulsion layer containing at least one compound of Formula (I) (said compound is hereunder referred to as the pyrazolotriazole based magenta coupler of the present invention):

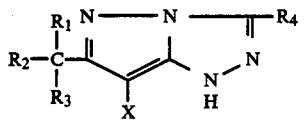

(I)

wherein X is a halogen atom or a monovalent organic group capable of leaving upon coupling reaction with the oxidized product of a developing agent; $R_1$ to $R_3$ which may be the same or different each represents a hydrogen atom, a halogen atom (e.g., Cl, Br or F), an alkyl group (an optionally substituted straight- or branched-chain alkyl group having 1–32 carbon atoms, such as a methyl, propyl, t-butyl, hexadecyl, 3-(3-pentadecylphenoxy)propyl, 3-(2,4-di-tert-amylphenoxy)-propyl, 3-(2,4-di-tert-amylphenoxy)ethyl, 3-(4-di-tert-amylphenoxy)propyl, or 2-[α-(3-tert-butyl-4-hydroxyphenoxy)tetradecanamidoethyl]group), a cycloalkyl group (e.g., cyclohexyl), an alkenyl group (e.g., propenyl), a cycloalkenyl group, an alkynyl group, an aryl group (e.g., phenyl, α- or β-naphthyl, 4-methylphenyl, 2,4,6-trichlorophenyl, or 4-[α-(3-tert-butyl-4-hydroxyphenyl)tetradecanamido]-2,6-dichlorophenyl), a heterocyclic group (e.g., pyridyl, thienyl or quinolyl), an acyl group (e.g., acetyl or benzoyl), a sulfonyl group, a sulfinyl group, a phosphonyl group (e.g., butyloctylphosphonyl), a carbamoyl group, a sulfamoyl group, a cyano group, a spiro compound residue (e.g., spiro-(3,3)heptane-1-yl), a bridged hydrocarbon compound residue (e.g., bicyclo(2,2,1)heptane-1-yl), an alkoxy group (e.g., methoxy, ethoxy, propoxy, isopropoxy or n-butyl), an aryloxy group (e.g., phenoxy), a heterocyclic oxy group (e.g., 1-phenyltetrazolyloxy), a siloxy group (e.g., trimethylsiloxy), an acyloxy group (e.g., acetyloxy), a carbamoyloxy group, an amino group, an acylamino group (e.g., acetylamino, benzamido, 3-(2,4-di-tert-amylphenoxy)butylamido, or 3-(3-pentadecylphenoxy)-butylamido), a sulfonamido group (e.g., methanesulfonamido), an imido group (e.g., succinimido), a ureido group, a sulfamoylamino group, an alkoxycarbonylamino group (e.g., methoxycarbonylamino or tetradecyloxycarbonylamino), an aryloxycarbonylamino group (e.g., phenoxycarbonylamino), an alkoxycarbonyl group (e.g., methoxycarbonyl), an aryloxycarbonyl group (e.g., phenoxycarbnyl), an alkylthio group (e.g., hexylthio or dodecylthio), an arylthio group (e.g., phenylthio) or a heterocyclic thio group (e.g., 3-pyridylthio), provided that at least two of $R_1$ to $R_3$ are other than hydrogen; $R_4$ is a hydrogen atom, an alkyl group (an optionally substituted straight- or branched-chain alkyl group having 1–32 carbon atoms, such as a methyl, propyl, t-butyl, hexadecyl, 3-(3-pentadecylphenoxy)propyl, 3-(2,4-di-tert-amylphenoxy)-propyl, 3-(dodecylsulfonyl)propyl, 2-(2,4-di-tert-amylphenoxy)ethyl, 3-(2,4-di-tert-amylphenoxy)propyl, 2-[α-(3-tert-butyl-4-hydroxyphenoxy)tetradecanamidoethyl]group), an aryl group (e.g., phenyl, α- or β naphthyl, 4-methylphenyl, 2,4,6-trichlorophenyl, or 4-[α-(3-tert-butyl-4-hydroxyphenoxy)tetradecanamido]-2,6-dichlorophenyl), a heterocyclic group (e.g., pyridyl, thienyl or quinolyl), an acylamino group (e.g., acetylamino, benzamido, 3-(2,4-di-tert-amylphenoxy)-butylamido, or 3-(3-pentadecylphenoxy)butylamido), an alkylamino group (e.g., methylamino, diethylamino, or n-dodecylamino), an anilino group (e.g., phenylamino, 2-chloro-5-tetradecanamidophenylamino, or 4-[α-(3-t-butyl-4-hydroxyphenoxy)tetradecanamido]anilino), an alkoxycarbonyl group (e.g., methoxycarbonyl or tetradecyloxycarbonyl) or an alkylthio group (e.g., hexylthio or dodecylthio).

PREFERRED EMBODIMENTS OF THE INVENTION

The pyrazolotriazole base magenta coupler represented by formula (I) is preferably represented by the following formula (IA):

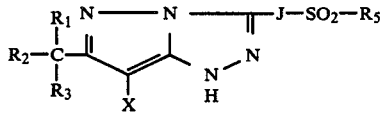

(IA)

wherein J is an alkylene group;

$R_5$ is an alkyl or aryl group; and X and $R_1$ to $R_3$ are as defined in formula (I).

Further details of the present invention are shown below.

The highly reactive yellow coupler incorporated in the blue-sensitive silver halide emulsion layer in accordance with the present invention has a relative coupling reaction rate of 0.3 or more, preferably 0.5 or more.

The coupling reaction rates of any two couplers may be determined as relative values by the following procedures: two couplers M and N providing dyes that are clearly distinguishable from each other are mixed and incorporated in a silver halide emulsion, and the amounts of dyes present in the color images provided by subjecting the emulsion to color development are measured.

If coupler M provides a maximum density (DM)max and forms a color with density DM during development, and if coupler N attains a maximum density (DM)max and provides a color with density DN during development, then the ratio of the reactivity of coupler M to that of coupler N, or RM, RN, can be expressed by the following equation:

$$\frac{RM}{RN} = \frac{\log\left(1 - \frac{DM}{(DM)_{max.}}\right)}{\log\left(1 - \frac{DN}{(DM)_{max.}}\right)}$$

In other words, the emulsion containing the mixed coupler is given varying amounts of exposure and subjected to color development, and the coupling reactivity ratio RM/RN is the gradient of a straight line obtained by plotting the logarithm of $$1 - \frac{DM}{(DM)_{max.}} \text{ and } 1 - \frac{DN}{(DM)_{max.}}$$

function of exposure.

Therefore, the relative coupling reaction rates of various couplers against a known coupler N may be determined by calculating the RM/RN value of each coupler of interest in accordance with the procedures described above.

For the purposes of the present invention, the following coupler is selected as reference coupler N:

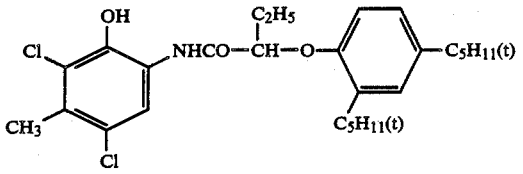

If the blue-sensitive silver halide emulsion layer in accordance with the present invention is composed of two or more sublayers, the highly reactive yellow coupler of the present invention may be present in at least one such sublayer.

The amount of the highly reactive yellow coupler of the present invention is not limited to any particular value but, preferably, it is present in an amount of $2\times10^{-3}$ to $5\times10^{-1}$, more preferably $1\times10^{-2}$ to $5\times10^{-1}$, mole per mole of the silver in the blue-sensitive silver halide emulsion layer.

The highly reactive yellow coupler to be used in the present invention is preferably represented by the following formula (II):

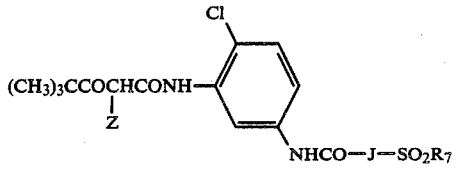

(II)

wherein J is an alkylene group having 2 to 5 carbon atoms; $R_7$ is an alkyl group having 10 to 20 carbon atoms or a phenyl group having as a substituent an alkyl or alkoxy group having 5 to 20 carbon atoms; and Z is

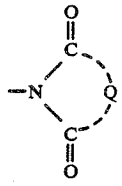

wherein Q is the atomic group necessary to form a 5-membered.

Specific examples of the highly reactive yellow coupler of the present invention are given below but they are by no means intended as limiting.

Illustrative compounds:

(Y-1)

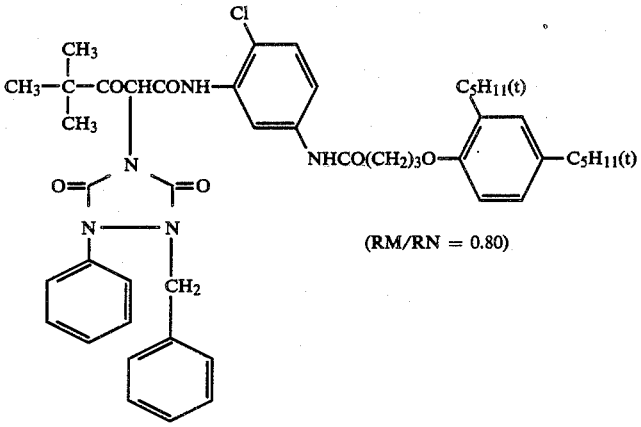

(RM/RN = 0.80)

(Y-2)

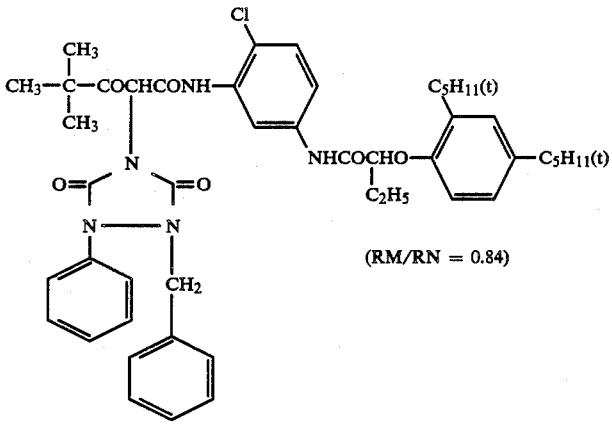

(RM/RN = 0.84)

-continued
(Y-3)
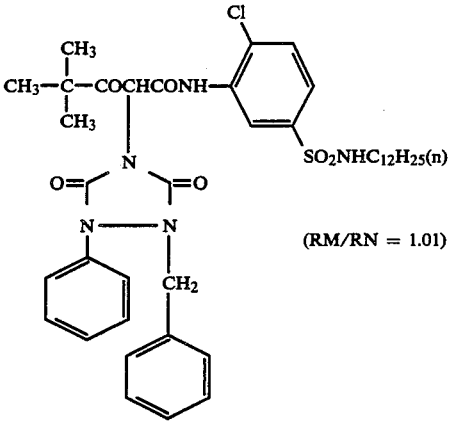
(RM/RN = 1.01)
(Y-4)
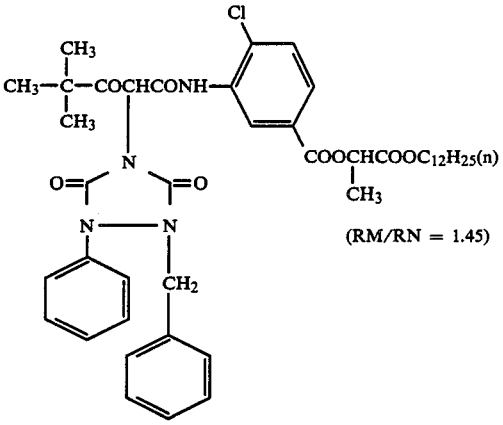
(RM/RN = 1.45)
(Y-5)
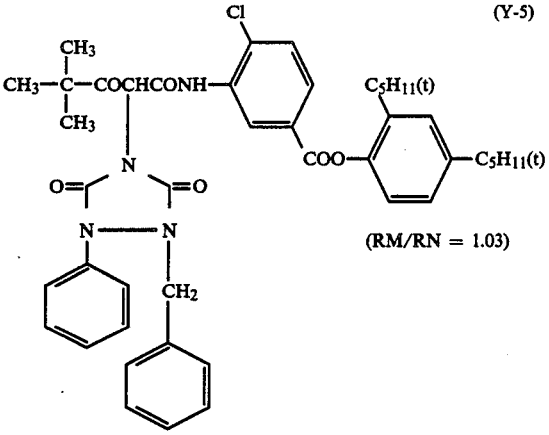
(RM/RN = 1.03)
(Y-6)
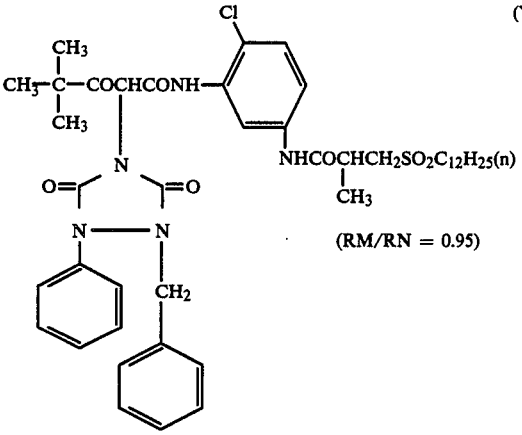
(RM/RN = 0.95)
(Y-7)
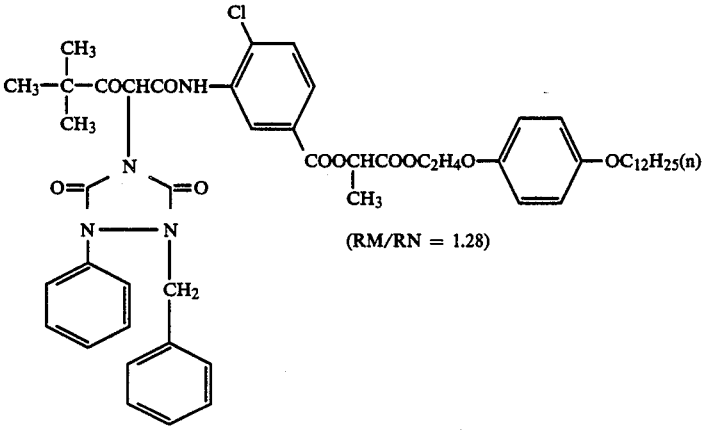
(RM/RN = 1.28)
(Y-8)
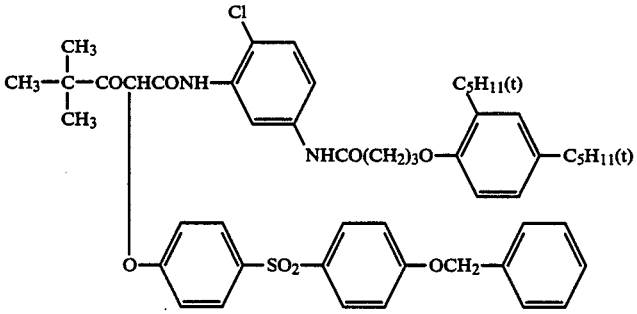
(RM/RN = 0.65)

-continued
(Y-9)
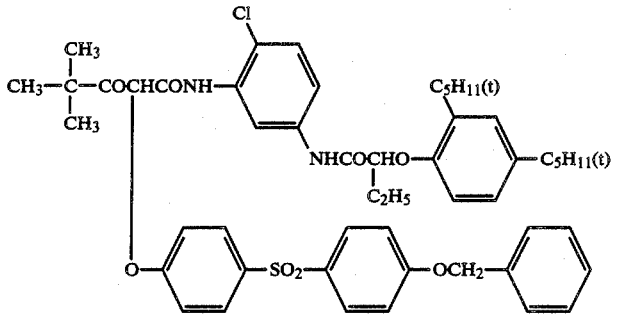
(RM/RN = 0.92)
(Y-10)
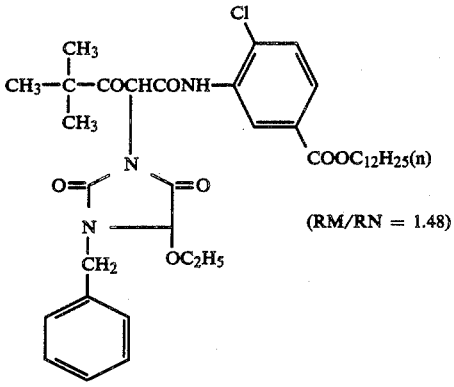
(RM/RN = 1.48)
(Y-11)
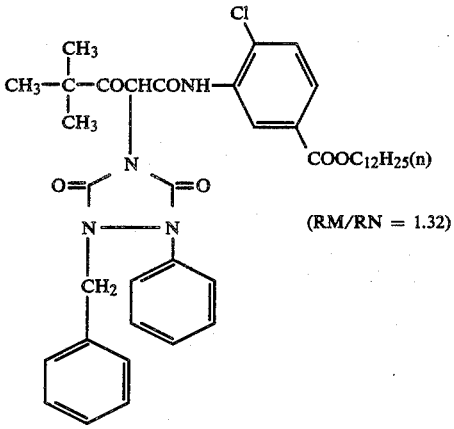
(RM/RN = 1.32)
(Y-12)
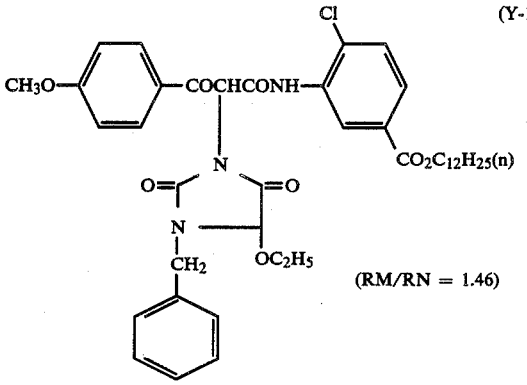
(RM/RN = 1.46)
(Y-13)
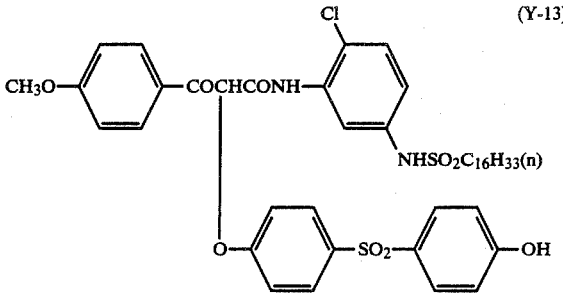
(RM/RN = 1.27)
(Y-14)
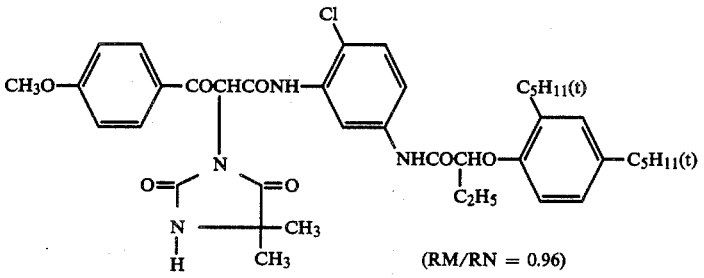
(RM/RN = 0.96)

-continued
(Y-15)
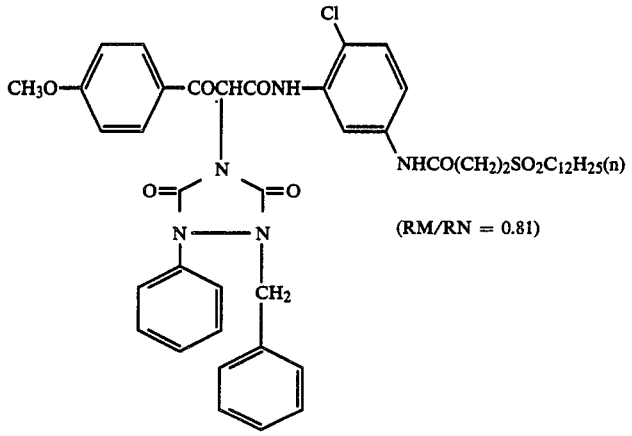
(RM/RN = 0.81)
(Y-16)
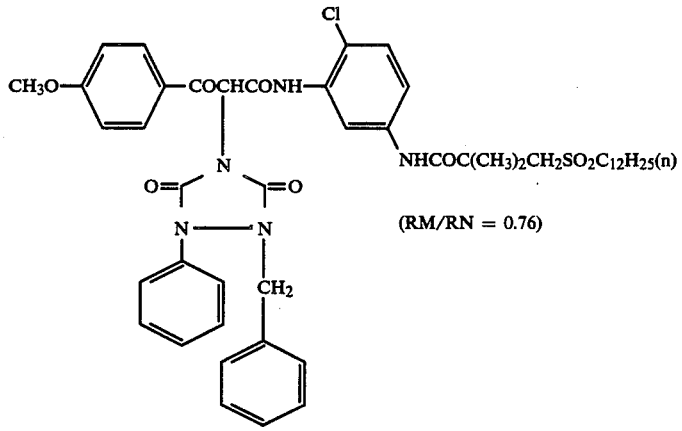
(RM/RN = 0.76)
(Y-17)
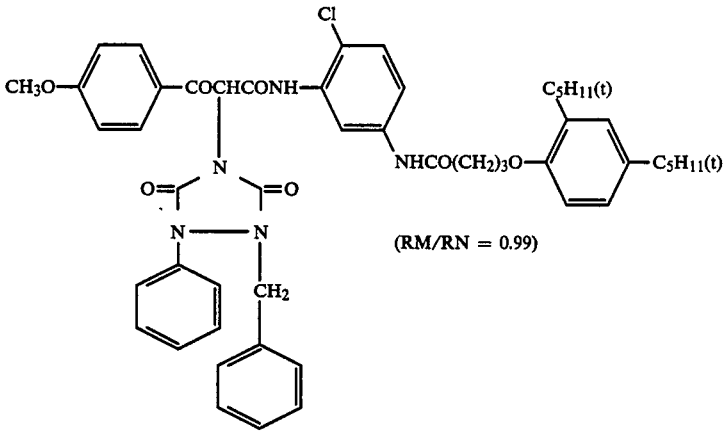
(RM/RN = 0.99)

-continued
(Y-18)
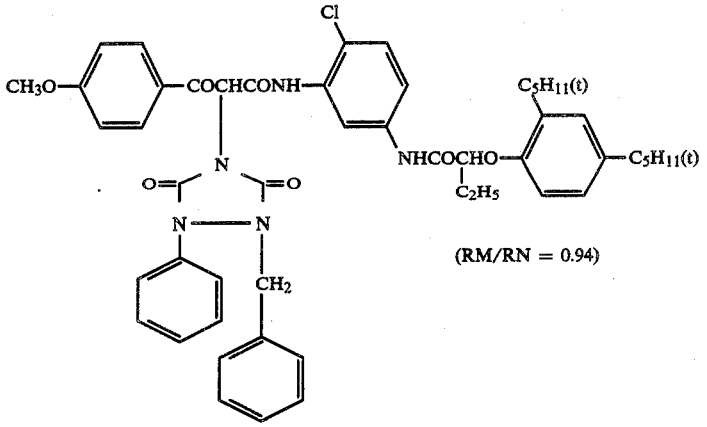
(RM/RN = 0.94)
(Y-19)
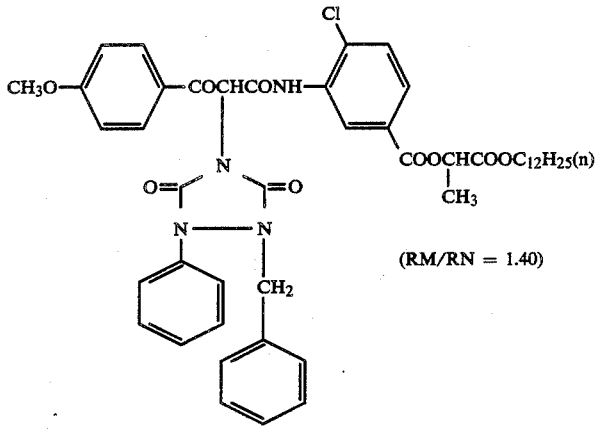
(RM/RN = 1.40)
(Y-20)
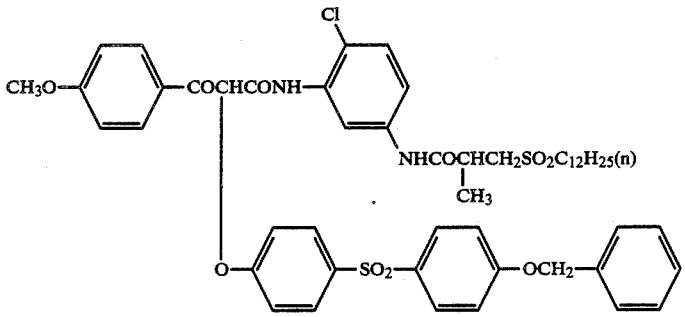
(RM/RN = 0.88)
(Y-21)
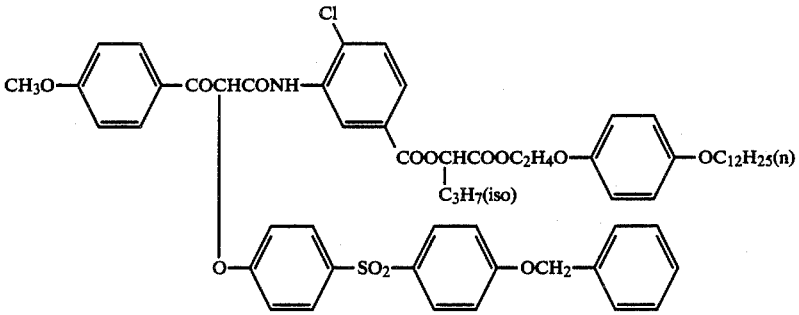
(RM/RN = 1.19)

-continued

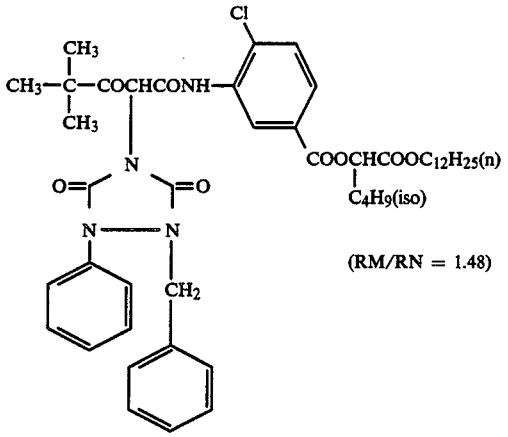

(Y-22)

(RM/RN = 1.48)

The highly reactive yellow couplers listed above may be readily synthesized by following the procedures described in Japanese Patent Publication No. 10783/1976, and Unexamined Published Japanese Patent Application Nos. 102636/1976 and 123342/1975.

The pyrazolotriazole based magenta coupler of the present invention is incorporated in the green-sensitive silver halide emulsion layer. If the green-sensitive silver halide emulsion layer is composed of two or more sublayers, said magenta coupler may be present in at least one such sublayer.

The amount of the pyrazolotriazole based magenta coupler of the present invention is not limited to any particular value but, preferably, it is present in an amount of $2\times10^{-3}$ to $5\times10^{-1}$, more preferably $1\times10^{-2}$ to $5\times10^{-1}$, mole per mole of the silver in the green-sensitive silver halide emulsion layer.

Several examples of the pyrazolotriazole based magenta coupler are shown in Japanese Patent Application Nos. 241648/1984, 243007/1984, 243008/1984, 243009/1984, 243010/1984 and 243011/1984. The pyrazolotriazole based magenta coupler suitable for use in the present invention may be synthesized by following the procedures described in these patent applications.

Specific examples of the pyrazolotriazole based magenta coupler of the present invention are given below but they are by no means intended as limiting.

Illustrative compounds (1)

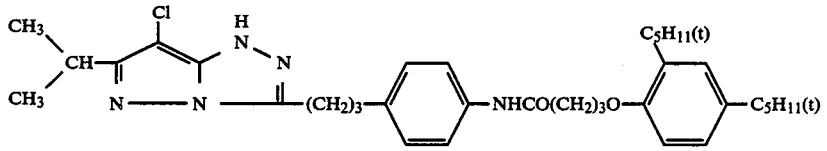

(2)

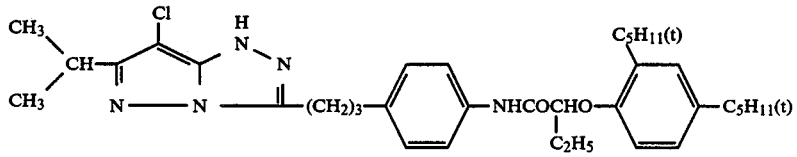

(3)

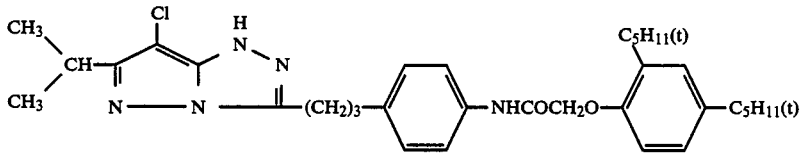

(4)

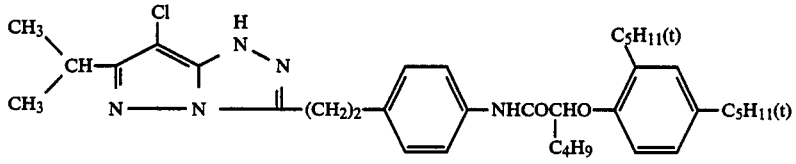

-continued
Illustrative compounds
(5)
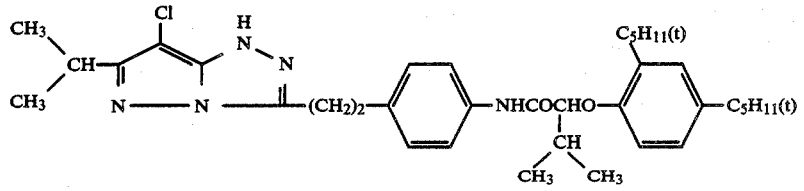
(6)
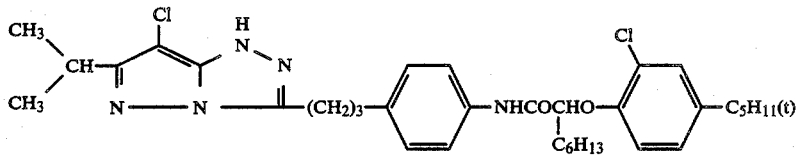
(7)
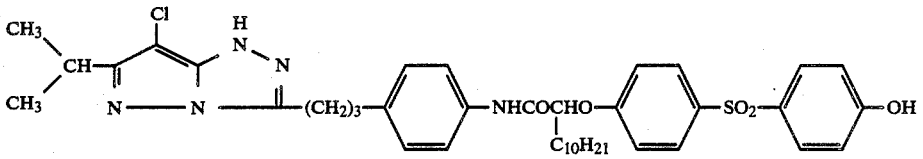
(8)
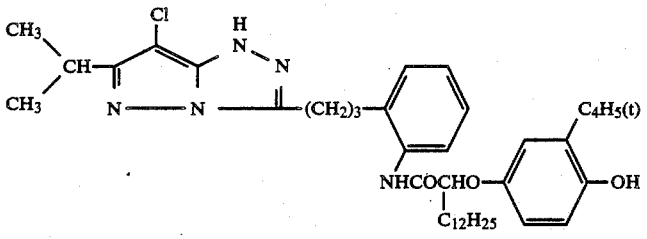
(9)
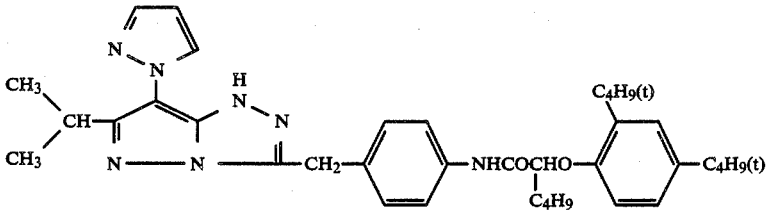
(10)
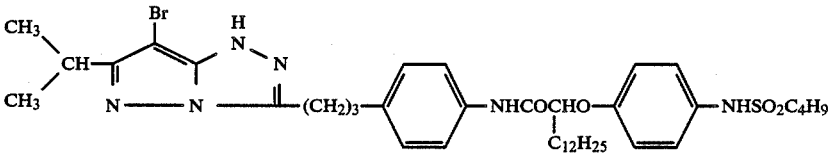
(11)
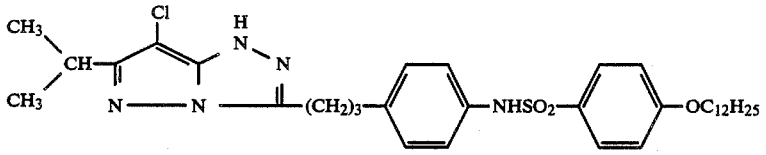
(12)
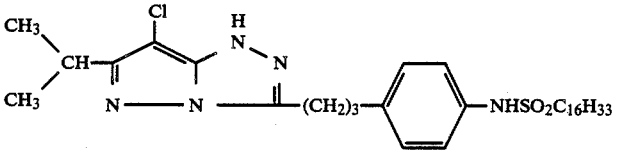

-continued
Illustrative compounds
(13)
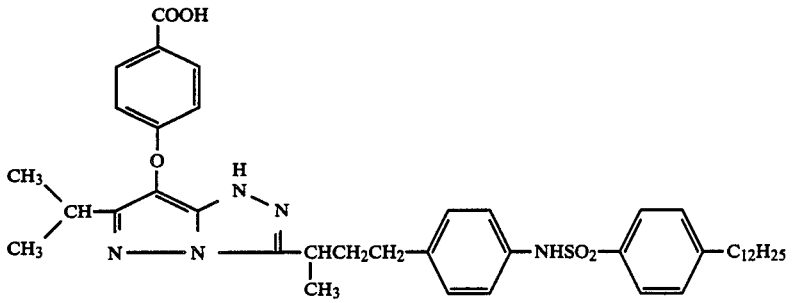
(14)
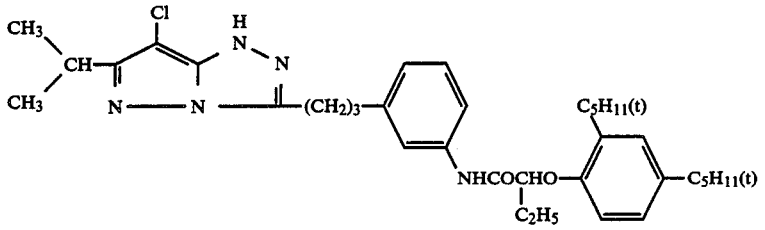
(15)
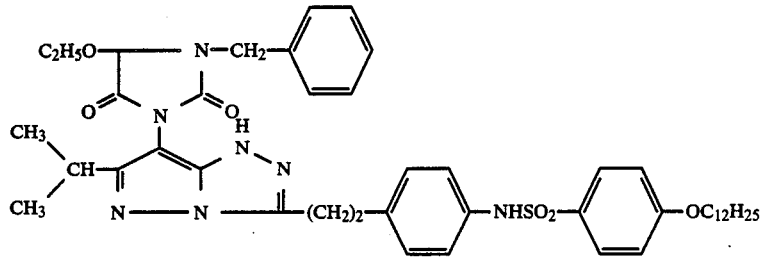
(16)
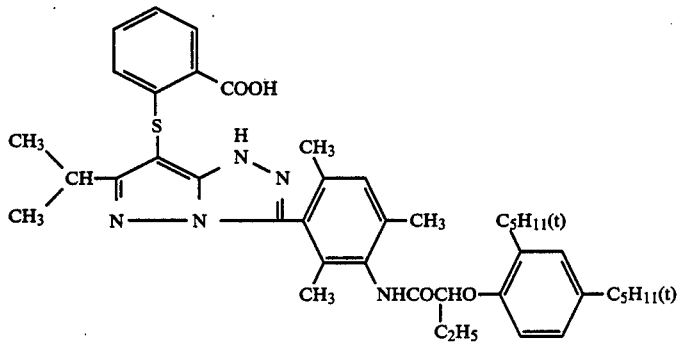
(17)
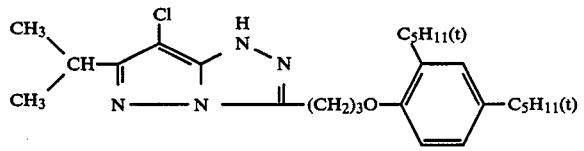
(18)
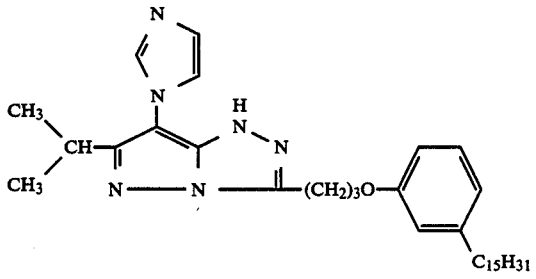

-continued
Illustrative compounds
(19)
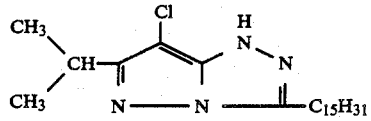
(20)
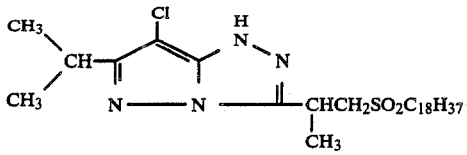
(21)
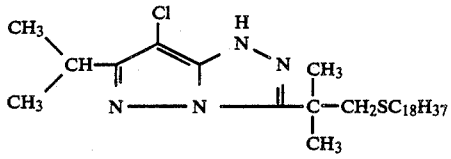
(22)
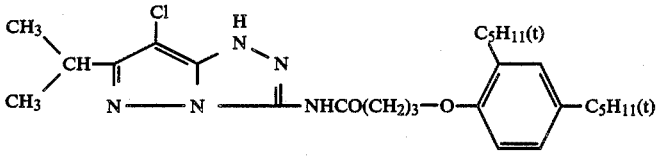
(23)
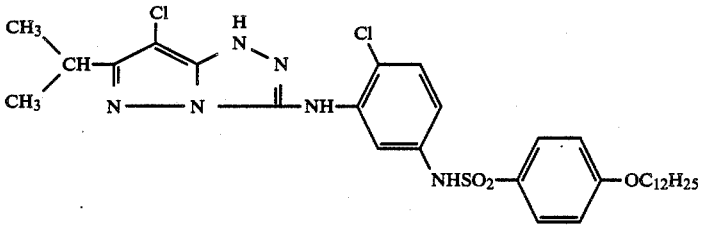
(24)
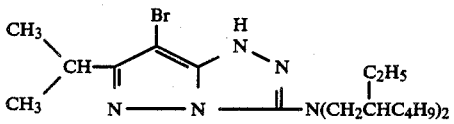
(25)
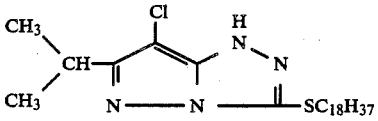
(26)
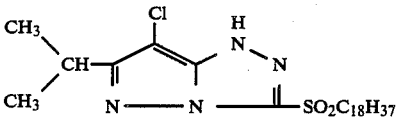
(27)
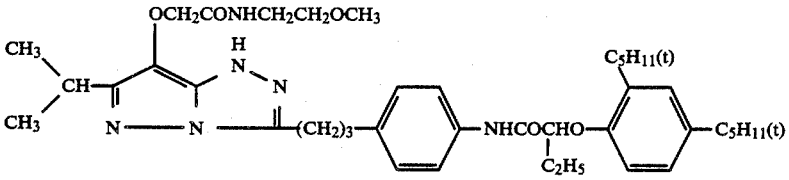
(28)
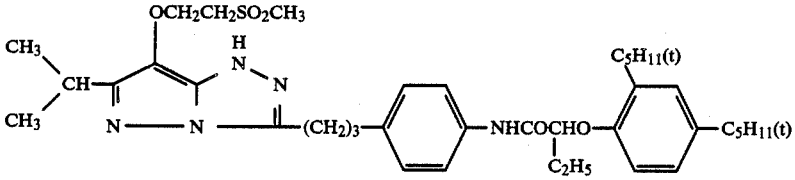

-continued
Illustrative compounds
(29)
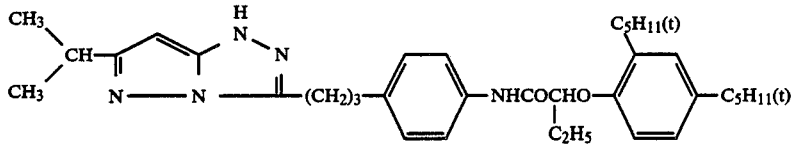
(30)
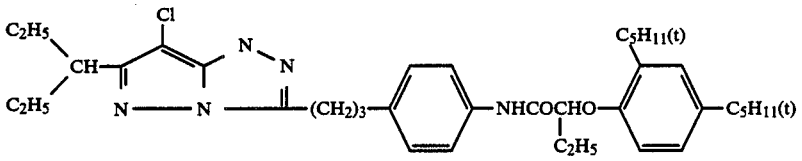
(31)
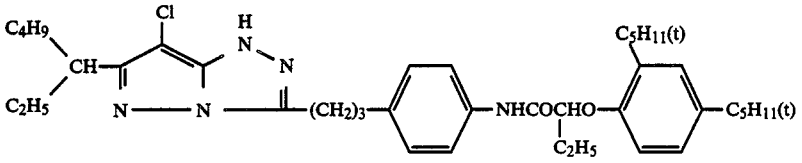
(32)
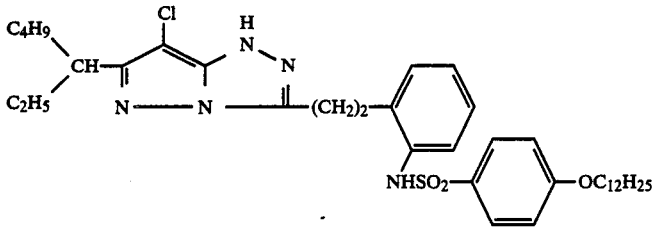
(33)
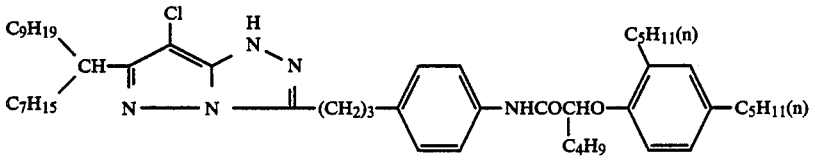
(34)
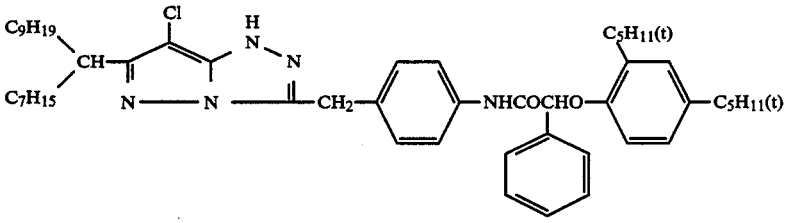
(35)
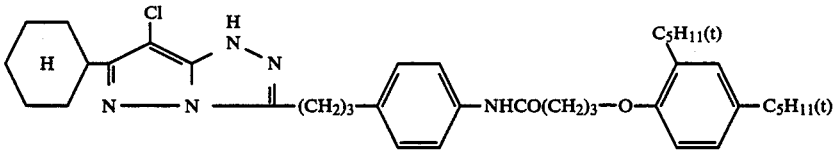
(36)
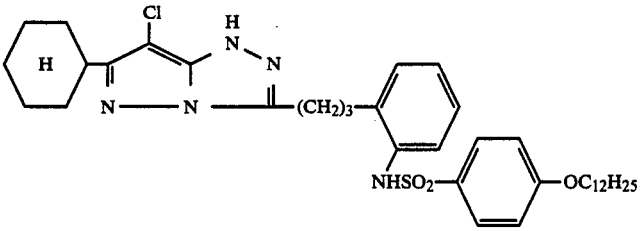

-continued
Illustrative compounds
(37)
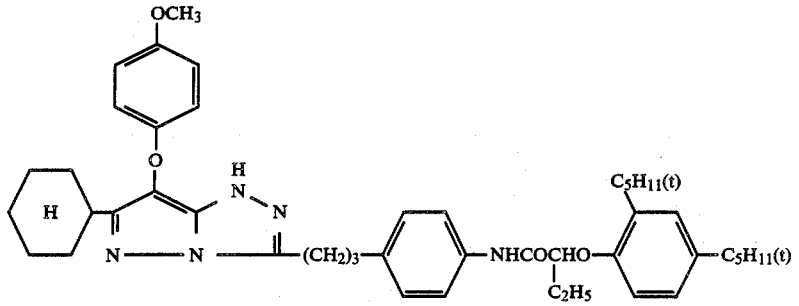
(38)
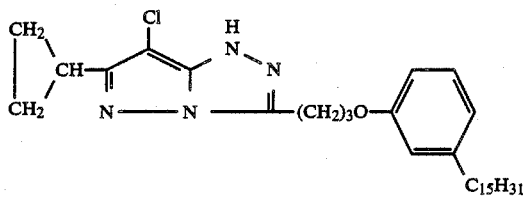
(39)
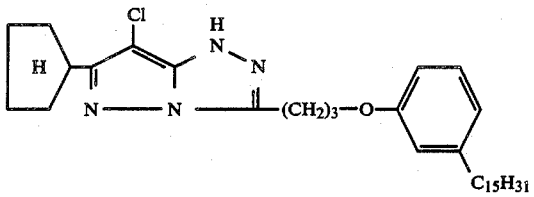
(40)
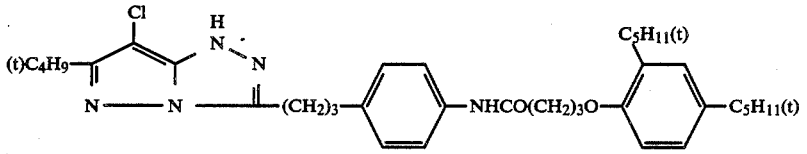
(41)
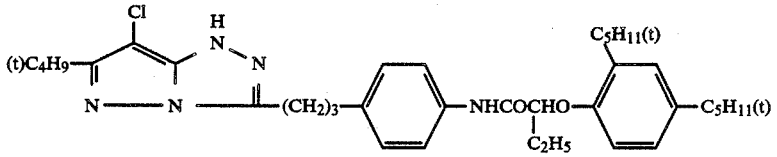
(42)
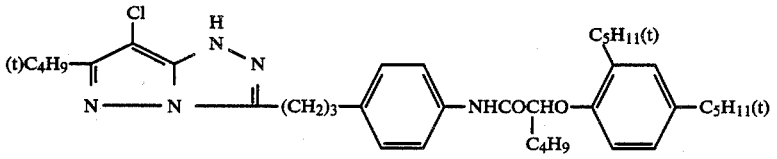
(43)
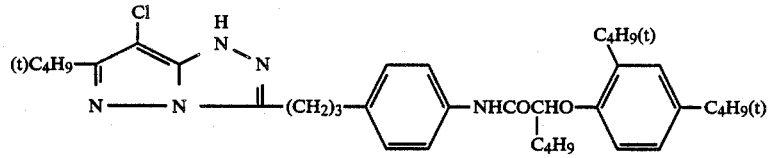
(44)
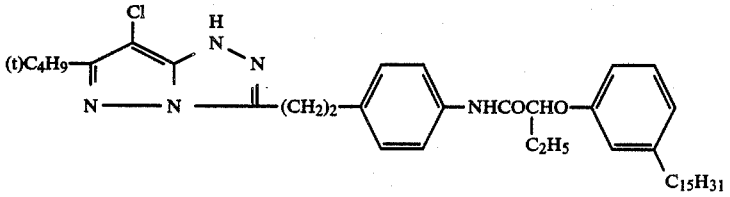

-continued
Illustrative compounds
(45)
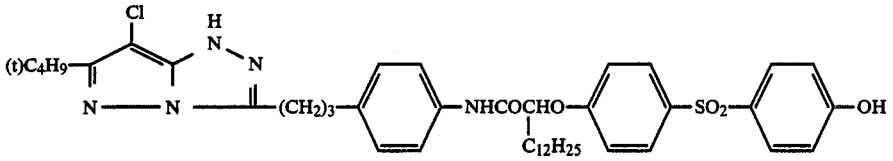
(46)
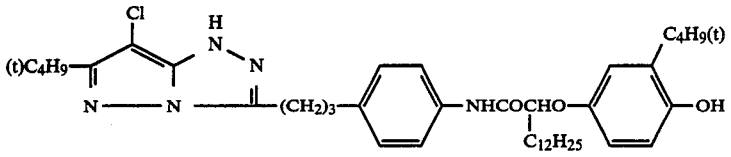
(47)
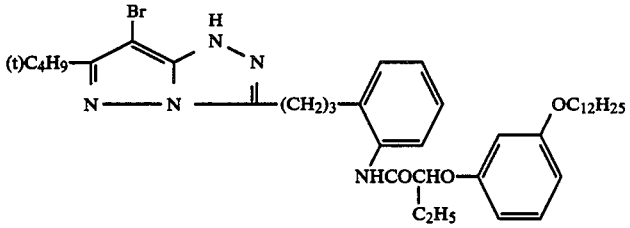
(48)
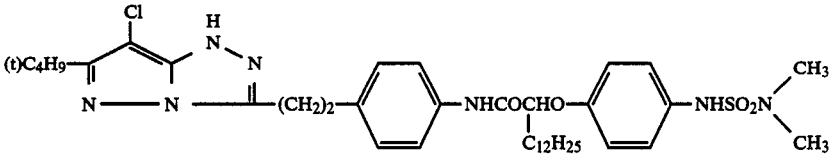
(49)
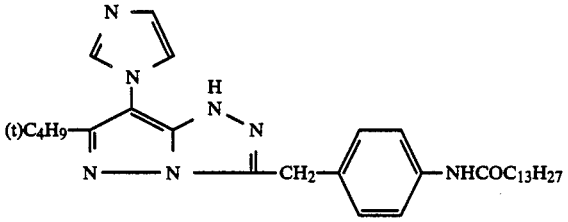
(50)
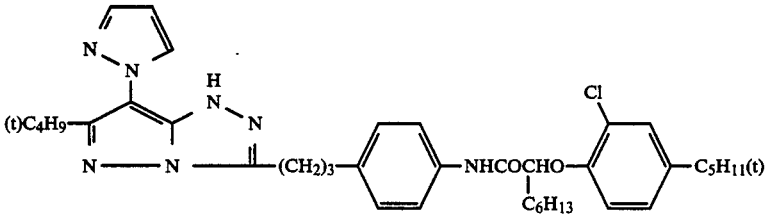
(51)
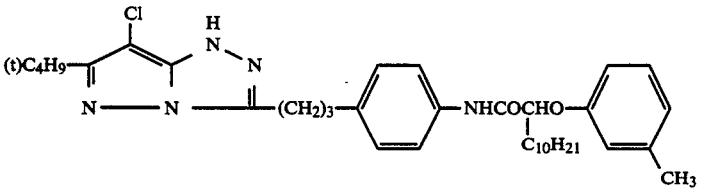
(52)
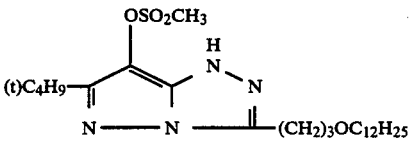

-continued
| Illustrative compounds | |
|---|---|
| 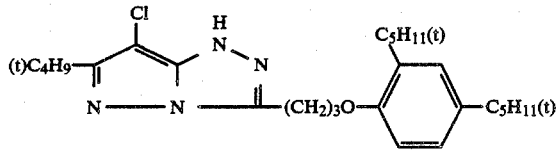 | (53) |
| 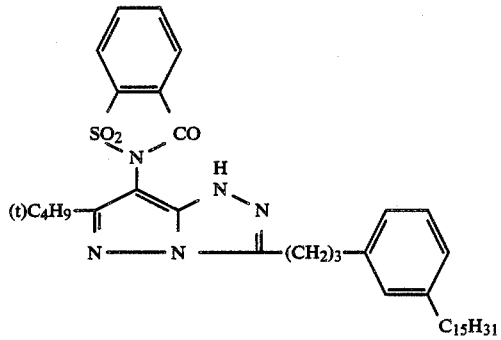 | (54) |
| 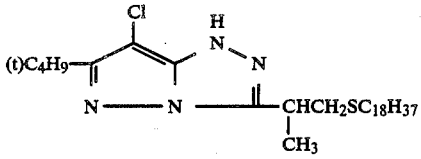 | (55) |
| 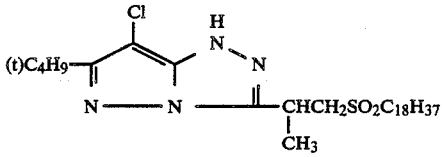 | (56) |
| 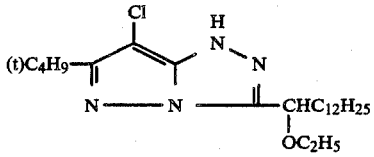 | (57) |
| 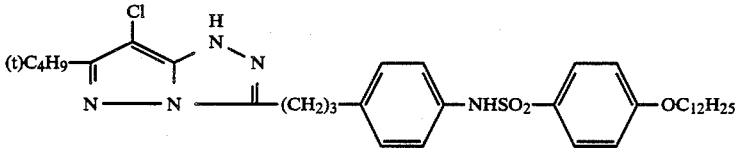 | (58) |
| 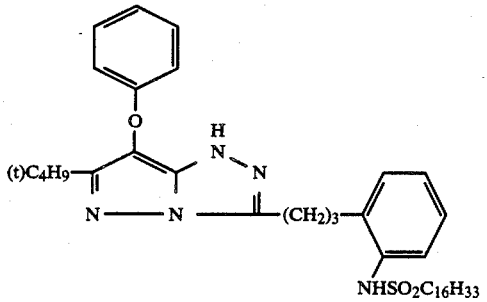 | (59) |

-continued
Illustrative compounds
(60)
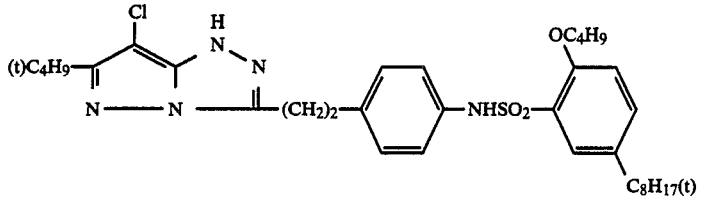
(61)
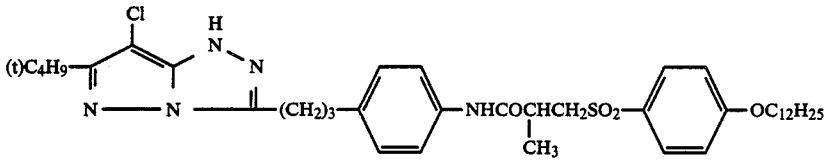
(62)
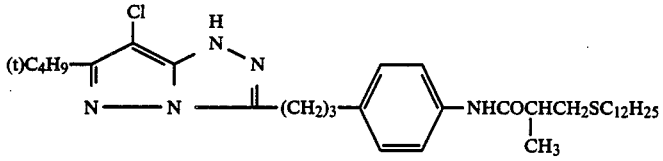
(63)
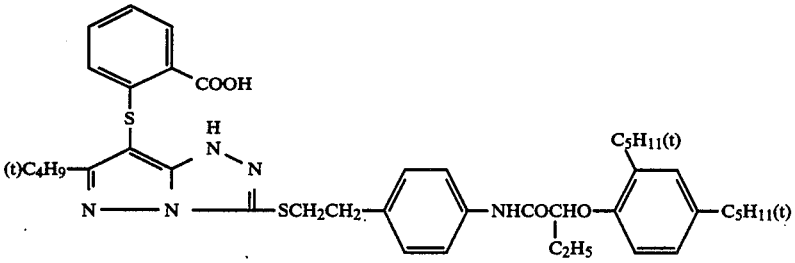
(64)
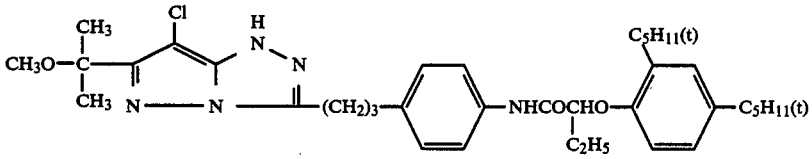
(65)
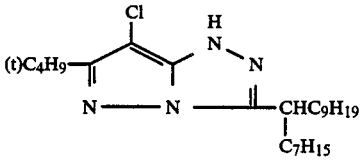
(66)
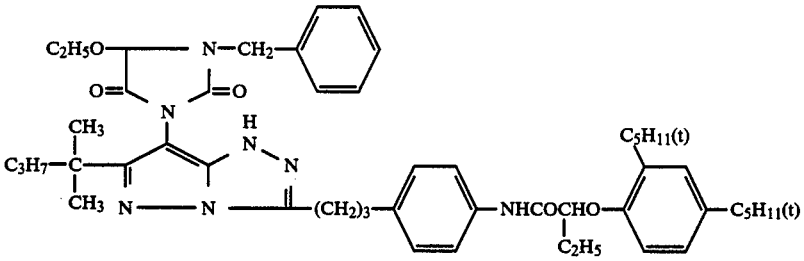
(67)
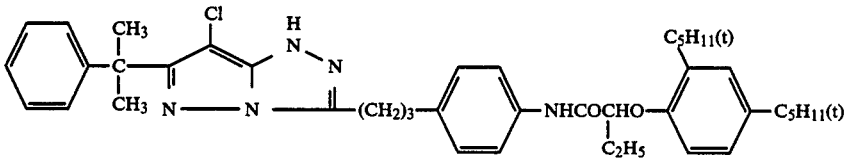

-continued
Illustrative compounds
(68)
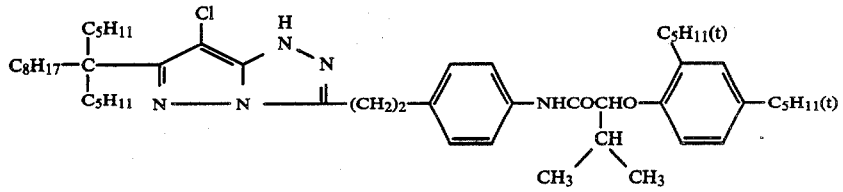
(69)
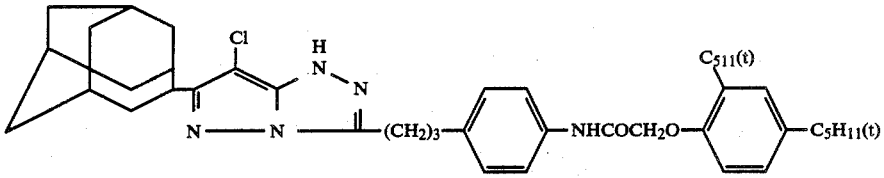
(70)
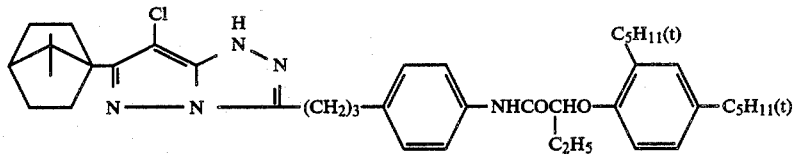
(71)
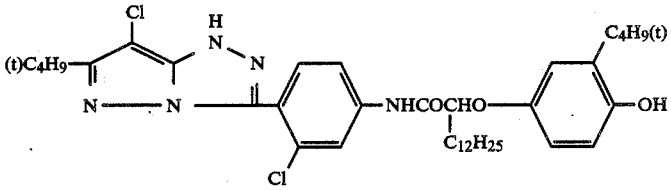
(72)
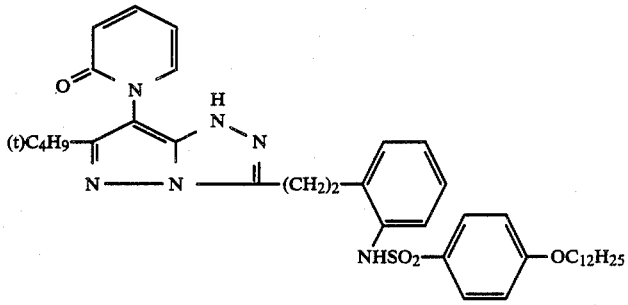
(73)
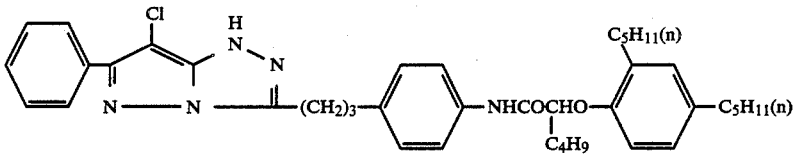
(74)
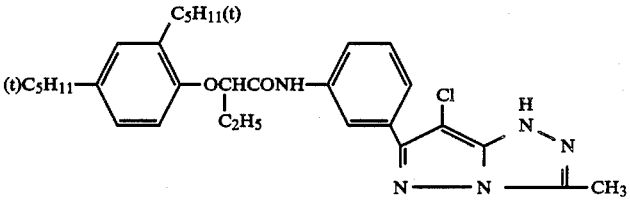

-continued

| Illustrative compounds | |
|---|---|
| 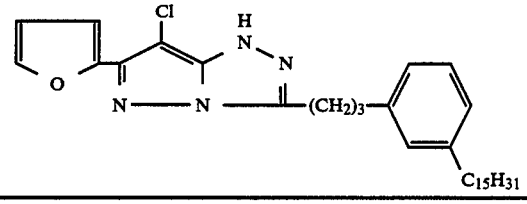 | (75) |

The amount of silver (i.e., silver deposit) in the silver halide emulsion layers included in silver halide color photographic material of the present invention is not limited to any particular value but it is preferred that the overall amount of silver in the light-sensitive silver halide emulsion layers is within the range of 0.3–1 g/m$^2$. In order to produce superior images, the silver deposit is preferably no more than 1 g/m$^2$, and in order to provide high maximum densities and sensitivities, the silver deposit is preferably no less than 0.3 g/m$^2$. A particularly preferred range of the silver deposit is from 0.4 to 0.8 g/m$^2$.

Silver halide compositions that are preferably employed in the present invention are silver chlorobromide and silver chloroiodobromide. Mixed compositions such as a mixture of silver chloride and silver bromide may also be used. In case of a silver halide emulsion that is used in a color photographic paper which requires particularly high developability, the halogen composition in the silver halide preferably contains a chlorine atom, and silver chlorobromide or silver chloroiodobromide containing at least 1% of silver chloride is particularly preferred.

The silver halide emulsion used in the present invention may be a polydisperse emulsion which comprises silver halide grains having a relatively broad range of size-frequency distribution, but a substantially monodisperse emulsion is preferred.

The substantially monodisperse silver halide grains are those which, when observed under an electron microscope, assume the same shape and have a uniform particle size and which are characterized by $$\frac{s}{\bar{r}} \leqq 0.15,$$

where s is the standard deviation of the size distribution and $\bar{r}$ is the arithmetic average particle size.

The silver halide grains used in the present invention may be crystallographically complete, or twinned or in other crystal shapes. These grains may have any proportions of (1.0.0.) and (1.1.1.) surfaces. The grains may have a uniform composition throughout or may have a laminar structure (of the core/shell type) wherein the interior has a different silver halide composition from the surface. The silver halide grains may be of the surface latent image type or the internal latent image type. If desired, tabular silver halide grains (see Japanese Patent Application No. 170070/1984) may be employed.

The substantially monodisperse silver halide grains which are preferably used in the present invention may be prepared by any known method such as, for example, the acid method, neutral method or ammoniacal method. In one possible method, seed grains are first prepared by the acid method and then they are grown to a predetermined size by the ammoniacal method which is capable of rapid crystal growth. It is preferred for the purpose of growing silver halide grains that pH, pAg and other conditions in the reactor are controlled and that silver and halide ions in amounts commensurate with the rate of growth of the silver halide grains are added, either sequentially or simultaneously, for mixing with the grains as described in Unexamined Published Japanese Patent Application No. 48521/1979.

The silver halide grains used in the present invention are preferably prepared by the procedures described above. A composition containing the so prepared silver halide grains is hereunder referred to as the silver halide emulsion.

The silver halide emulsion used in the present invention may be chemically sensitized by, for example, activated gelatin, a sulfur sensitizer such as an allyl thiocarbamide, thiourea or cystine, a selenium sensitizer, a reduction sensitizer such as a stannous salt, thiourea dioxide or polyamine, a noble metal sensitizer such as a gold sensitizer (e.g., potassium aurithiocyanate, potassium chloroaurate, or 2-aurothio-3-methylbenzothiazolium chloride) or a water-solution salt of any other suitable noble metal such as ruthenium, palladium, platinum, rhodium or iridium (e.g., ammonium chloropalladate, potassium chloroplatinate or sodium chloropalladate). Certain of these compounds will serve either as a sensitizer or as an anti-foggant depending upon their amount. The chemical sensitizers listed above may be used independently or in combination (e.g., a gold sensitizer with a sulfur sensitizer, or with a selenium sensitizer).

If desired, the silver halide emulsion used in the present invention may be chemically ripened with a sulfur-containing compound and, prior to, during or after this ripening step, the emulsion may be mixed with at least one hydroxytetrazaindene and at least one nitrogen-containing heterocyclic compound having a mercapto group.

The silver halide used in the present invention may be provided with sensitivity to light in a desired spectral range by addition of the appropriate sensitizing dye in an amount of $5\times10^{-8}$ to $3\times10^{-3}$ mole per mole of silver halide. A variety of sensitizing dyes may be used for this purpose of spectral sensitization, and they may be employed either independently or in combination. Sensitizing dyes that are used with particular advantage in the present invention are described below.

Sensitizing dyes suitable for use with the blue-sensitive silver halide emulsion are listed in German Pat. No. 929,080; U.S. Pat. Nos. 2,231,658, 2,493,748, 2,503,776, 2,519,001, 2,912,329, 3,656,959, 3,672,897, 3,694,217, 4,025,349, and 4,046,572; British Pat. No. 1,242,588; and Japanese Patent Publication Nos. 14030/1969 and 24844/1977. Typical examples of the sensitizing dyes suitable for use with the green-sensitive silver halide emulsion include cyanine dyes, merocyanine dyes and complex cyanine dyes of the types described in U.S. Pat. Nos. 1,939,201, 2,072,908, 2,739,149 and 2,945,763; and British Pat. No. 505,979. Typical examples of the sensitizing dyes suitable for use with the red-sensitive silver halide emulsion include cyanine dyes, merocyanine dyes and complex cyanine dyes of the types described in U.S. Pat. Nos. 2,269,234, 2,270,378, 2,442,710, 2,454,629 and 2,776,280. The cyanine dyes, merocyanine dyes and complex cyanine dyes described in U.S. Pat. Nos. 2,213,995, 2,493,748 and 2,519,001, and German Pat. No. 929,080 may also be used advantageously with the green- or red-sensitive silver halide emulsion.

The sensitizing dyes listed above may be used either independently or in combination.

The photographic material of the present invention may be sensitized for a desired wavelength range by spectral sensitization with cyanine or merocyanine dyes used either independently or in combination. A typical example of the particularly preferred method of spectral sensitization involves the use of benzimidazolocarbocyanine in combination with benzoxazolocarbocyanine, as shown in Japanese Patent Publication Nos. 4936/1968, 22884/1968, 18433/1970, 37443/1972, 28293/1973, 6209/1974 and 12375/1978; and Unexamined Published Japanese Patent Application Nos. 23931/1977, 51932/1977, 80118/1979, 153926/1983, 116646/1984 and 116647/1984. Another method of spectral sensitization involves the use of a carbocyanine having the benzimidazole nucleus in combination with another cyanine or merocyanine, as described in Japanese Patent Publication Nos. 25831/1970, 11114/1972, 25379/1972, 38406/1973, 38407/1973, 34535/1979 and 1569/1980; and Unexamined Published Japanese Patent Application Nos. 33220/1975, 38526/1975, 107127/1976, 115820/1976, 135528/1976, 104916/1977 and 104917/1977. Still another method of spectral sensitization involves the use of benzoxazolocarbocyanine (oxacarbocyanine) together with another carbocyanine, as shown in Japanese Patent Publication Nos. 32753/1969 and 11627/1971; and Unexamined Published Japanese Patent Application No. 1483/1972. For the use of merocyanines, see Japanese Patent Publication Nos. 38408/1973, 41204/1973 and 40662/1975; and Unexamined Published Japanese Patent Application Nos. 25728/1981, 10753/1983, 91455/1983, 116645/1984 and 33828/1975. A further method of spectral sensitization involves the use of thiacarbocyanine in combination with another carbocyanine, as shown in Japanese Patent Publication Nos. 4932/1968, 4933/1968, 26470/1970, 18107/1971 and 8741/1972; and Unexamined Published Japanese Patent Application No. 114533/1984. Another advantageous method is described in Japanese Patent Publication No. 6207/1974 and involves the use or zeromethine or dimethine merocyanine, or monomethine or trimethine cyanine, in combination with a styryl dye.

The sensitizing dyes described above are added to the silver halide emulsion of the present invention in the form of dye solutions wherein such dyes are dissolved in hydrophilic organic solvents such as methyl alcohol, ethyl alcohol, acetone, dimethylformamide, and the fluorinated alcohol described in Japanese Patent Publication No. 40659/1975. The prepared solutions may be added to the silver halide emulsion at any stage, i.e., prior to, during or after the chemical ripening of the emulsion. If desired, the solutions may be added at a time immediately before the coating of an emulsion layer.

The silver halide color photographic material of the present invention may incorporate a water-soluble dye in a hydrophilic colloid layer either as a filter dye or for achieving various objects such as preventing irradiation. Suitable water-soluble dyes include oxonole dyes, hemioxonole dyes, merocyanine dyes and azo dyes, among which oxonole dyes, hemioxonole dyes and merocyanine dyes are particularly advantageous. Specific examples of the usable dyes are listed in British Pat. Nos. 584,609 and 1,277,429; Unexamined Published Japanese Patent Application Nos. 85130/1973, 99620/1974, 114420/1974, 129537/1974, 108115/1977 and 25845/1984; and U.S. Pat. Nos. 2,274,782, 2,533,472, 2,956,879, 3,125,448, 3,148,187, 3,177,078, 3,247,127, 3,540,887, 3,575,704, 3,653,905, 3,718,472, 4,071,312 and 4,070,352.

The blue-sensitive silver halide emulsion layer in the photographic material of the present invention must contain the highly reactive yellow coupler defined hereinbefore, but it should be noted that said blue-sensitive silver halide emulsion layer may also contain a yellow coupler that is outside the scope of the present invention. In this case, the amount of the yellow coupler outside the scope of the present invention is preferably less than 45 mol% of the total amount of the yellow couplers used. As also mentioned before, the green-sensitive silver halide emulsion layer in the photographic material of the present invention must contain the pyrazolotriazole based magenta coupler defined hereinbefore but again, said green-sensitive silver halide emulsion layer may also contain a magenta coupler that is outside the scope of the present invention. In this case, the amount of the magenta coupler outside the scope of the present invention is preferably less than 45 mol% of the total amount of the magenta couplers used. The red-sensitive silver halide emulsion layer in the photographic material of the present invention may contain a coupler that is capable of reacting with the oxidized product of a color developing agent to form a cyan dye.

The yellow coupler that may be incorporated in the blue-sensitive silver halide emulsion layer in addition to the highly reactive yellow coupler defined hereinbefore, the magenta coupler optionally used in the green-sensitive silver halide emulsion layer together with the pyrazolotriazole based magenta coupler, and the cyan coupler that may be contained in the red-sensitive silver halide emulsion layer may be selected from among any known types of the respective couplers. These couplers may be two- or four-equivalent with respect to silver ions. They may also be used in combination with diffusible-dye releasing couplers.

Examples of the yellow coupler that may be used in combination with the highly reactive yellow coupler of the present invention include closed-chain ketomethylene compounds and what are generally referred to as two-equivalent couplers, such as active site-o-aryl substituted couplers, active site-o-acyl substituted couplers, active site-hydantoin compound substituted couplers, active site-urazole compound substituted couplers, active site-succinimide compound substituted couplers, active site-fluorine, chlorine or bromie substituted couplers, and active site-o-sulfonyl substituted couplers.

Examples of the magenta coupler that may be used in combination with the pyrazolotriazole based magenta coupler of the present invention include pyrazolone based compounds, pyrazolotriazole based compounds outside the scope of the present invention, pyrazolinobenzimidazole based compounds, and indazolone based compounds. As in the case of the yellow couplers illustrate above, these magenta couplers may be four- to two-equivalent. Specific examples of these magenta couplers are shown in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, and 3,891,445; German Pat. No. 1,810,464; German Patent Application (OLS) Nos. 2,408,665, 2,417,945, 2,418,959 and 2,424,467; Japanese Patent Publication No. 6031/1965; Unexamined Published Japanese Patent Application Nos. 20826/1976, 58922/1977, 129538/1974, 74027/1974, 159336/1975, 42121/1977, 74028/1974, 60233/975, 26541/1976 and 55122/1978; and Japanese Patent Application No. 110943/1980.

Illustrative cyan couplers useful in the present invention are phenolic and naphtholic couplers. Again, these cyan couplers may be four- or two-equivalent. Specific examples of the useful cyan couplers are disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494, and 4,004,929; German Patent Application (OLS) Nos. 2,414,830, and 2,454,329; Unexamined Published Japanese Patent Application Nos. 59838/1973, 26034/1976, 5055/1973, 146827/1976, 69624/1977, 90932/1977 and 95346/1983; and Japanese Patent Publication No. 11572/1974.

If the highly reactive yellow coupler and the pyrazolo-triazole based magenta coupler of the present invention, as well as the other couplers described above are alkali-soluble, they may be incorporated as alkaline solutions in the silver halide emulsion employed in the present invention. If these couplers are oil-soluble, they are preferably incorporated in the silver halide emulsion in accordance with any of the procedures described in U.S. Pat. Nos. 2,322,027, 2,801,170, 2,801,171, 2,272,191 and 2,304,940: the coupler is dissolved in a high-boiling point solvent, optionally together with a low-boiling point solvent, and a dispersion of fine particles of the coupler is added to the silver halide emulsion. If desired, hydroquinone derivatives, ultraviolet absorbers, anti-fading agents and other suitable compounds may be added together with the couplers. Of course, two or more couplers in combination may be added to the silver halide emulsion. A preferred method for incorporating couplers in the silver halide emulsion is hereunder described in detail: one or more couplers, optionally together with another coupler, a hydroquinone derivative, anti-fading agent or an ultraviolet absorber, are dissolved in high-boiling point solvents (e.g., organic acid amides, carbamates, esters, ketones, urea derivatives, ethers and hydrocarbons, especially di-n-butyl phthalate, tricresyl phosphate, triphenyl phosphate, di-isooctyl azelate, di-n-butyl sebacate, tri-n-hexyl phosphate, N,N-di-ethylcaprylamidobutyl, N,N-diethyllaurylamide, n-pentadecylphenyl ether, di-octylphthalate, n-nonylphenol, 3-pentadecylphenylethyl ether, 2,5-di-sec-amylphenylbutyl ether, and monophenyl-di-o-chlorophenyl phosphate and fluorinated paraffin) and/or low-boiling point solvents (e.g., methyl acetate, ethyl acetate, propyl acetate, butyl acetate, butyl propionate, cyclohexanol, diethylene glycol monoacetate, nitromethane, carbon tetrachloride, chloroform, cyclohexanetetrahydrofuran, methyl alcohol, acetonitrile, dimethylformamide, dioxane, and methyl ethyl ketone); the solution is mixed with an aqueous solution containing an anionic surfactant (e.g., alkylbenzenesulfonic acid or alkylnaphthalenesulfonic acid) and/or a non-ionic surfactant (e.g., sorbitan sesquioleate or sorbitan monolaurate) and/or a hydrophilic binder (e.g., gelatin); and the mixture is emulsified with a high-speed mixer, colloid mill or an ultrasonic disperser to make a dispersion of the couplers, which then is added to the silver halide emulsion.

The couplers may also be dispersed by the latex method. Details of the latex method and the resulting advantages are shown in Unexamined Published Japanese Patent Application Nos. 74538/1974, 59943/1976 and 32552/1979; and Research Disclosure No. 14850, pp. 77–79, August 1976. Suitable latices for use in this method are homo-, co- and terpolymers of such monomers as styrene, acrylates (e.g., n-butyl acrylate), n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropylacrylamide, N-[2-(2-methyl-4-oxopentyl)]acrylamide, 2-acrylamido-2-methylpropanesulfonic acid.

The silver halide color photographic material of the present invention may incorporate a variety of photographic additives such as those described in Research Disclosure No. 17643, i.e., anti-foggants, stabilizers, uv absorbers, anti-stain agents, brighteners, agents for preventing fading of color images, antistats, hardeners, surfactants, plasticizers and wetting agents.

Hydrophilic colloids are employed for preparing emulsions that are to be used in the silver halide color photographic material of the present invention. Any hydrophilic colloids may be used and are illustrated by proteins such as gelatin, derivatives thereof, graft polymers of gelatin and other high-molecular weight compounds, albumin and casein; cellulose derivatives such as hydroxyethyl cellulose and carboxymethyl cellulose; starch derivatives; homo- or copolymeric synthetic hydrophilic high-molecular weight compounds such as polyvinyl alcohol, polyvinyl imidazole and polyacrylamide.

Examples of the base that may be used with the silver halide color photographic material of the present invention include baryta paper, polyethylene-coated paper, synthetic polypropylene paper, transparent bases such as glass plate that are provided with a reflective layer or used together with a reflector, polyester films such as cellulose acetate, cellulose nitrate and polyethylene terephthalate, polyamide films, polycarbonate films, and polystyrene films. Customary transparent bases may also be used. A suitable base should be selected depending upon the specific use of the photographic material of the present invention.

The emulsion layers and other layers that make up the photographic material of the present invention may be coated by various methods such as dip coating, air doctor coating, curtain coating and hopper coating. Two or more layers may be coated simultaneously by using the methods described in U.S. Pat. Nos. 2,761,791 and 2,941,898.

In the photographic material of the present invention, the order of the arrangement of emulsion layers is not critical; if the photographic material is used as full-color photographic paper, a preferred layer arrangement is such that a blue-sensitive silver halide emulsion is disposed closest to the base and successively coated with green- and red-sensitive silver halide emulsion layers.

The photographic material of the present invention may be provided with intermediate layers whose thickness will vary depending upon the specific use of the material. Other layers that may be used in suitable combinations include a filter layer, an anti-curl layer, a protective layer, and an anti-halation layer. Hydrophilic colloids of the same types as employed in the silver halide emulsion layers may likewise be incorporated as binders in the aforementioned optional photographic layers. The photographic additives that can be incorporated in the silver halide emulsion layers and which are identified above may also be contained in said optional photographic layers.

The photographic material employing the silver halide emulsion of the present invention may be processed by any of the known procedures. Typical processing schemes are shown below: (1) color development followed by bleach-fixing, which may optionally be followed by rinsing and/or stabilization; (2) color development, follosed by separate steps of bleaching and fixing, which may optionally be followed by rinsing and/or stabilization; (3) a process comprising the sequential steps of pre-hardening, neutralization, color development, stop-fixing, rinsing, bleaching, fixing, rinsing, post-hardening and rinsing; (4) a process comprising the sequential steps of color development, rinsing, auxiliary color development, stopping, bleaching, fixing, rinsing and stabilization; and (5) color development, followed by the halogenation bleaching of the developed silver and another run of color development so as to produce an increased amount of dye.

The color developing solution employed for the purpose of developing the silver halide emulsion of the present invention is an aqueous alkaline solution that contains a color developing agent and which preferably has a pH of at least 8, more preferably within the range of 9 to 12. An aromatic primary amino compound is used as the developing agent; this compound has a primary amino group on the aromatic ring and is capable of developing an exposed silver halide. If necessary, a precursor that will form such an aromatic primary amino compound may be incorporated in the developing solution.

Typical aromatic primary amino developing agents are those which are based on p-phenylenediamine compounds and preferred examples thereof are listed below: 4-amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-ethyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, as well as salts thereof with, for example, sulfuric acid, hydrochloric acid, sulfurous acid and p-toluenesulfonic acid.

Other typical examples of the aromatic primary amino developing agents are shown in Unexamined Published Japanese Patent Application Nos. 64932/1973, 131526/1975 and 95849/1976, and Bent, R. L. et al.; Journal of the American Chemical Society, 73, 3100–3125 (1951).

The amount in which the aforementioned aromatic primary amino compounds should be used depends on the activity desired for the developing solution, and it is preferred to use greater amounts of these primary amino compounds if one wants to attain a higher activity. The primary amino compounds are generally employed in amounts ranging from 0.0002 to 0.7 moles per liter. Two or more primary amimo compounds may be used in combination depending upon the specific object; illustrative combinations are 3-methyl-4-amino-N,N-diethylaniline/3-methyl-4-amino-N-ethyl-N-β-methanesulfonamidoethylaniline, and 3-methyl-4-amino-N-ethyl-N-β-methanesulfonamidoethylaniline/3-methyl-4-amino-N-ethyl-N-β-hydroxyethylaniline.

The color developing solution for use in the present invention may incorporate commonly employed additives such as, for example, alkali agents (e.g., sodium hydroxide and sodium carbonate), alkali metal sulfites, alkali metal hydrogensulfites, alkali metal thiocyanates, alkali metal halides, benzyl alcohol, water softening agents, thickeners and development accelerators.

Other additives may be incorporated in the color developing solution and they include bromides (e.g., potassium bromide and ammonium bromide), compounds for rapid processing (e.g., alkali iodides, nitrobenzoimidazole, mercaptobenzoimidazole, 5-methylbenzotriazole and 1-phenyl-5-mercaptotetrazole), antistain agents, preservatives, interimage effect accelerators, and chelating agents.

Compounds commonly employed as bleaching solutions for use in the bleaching step or as bleaching agents for use in the bleach-fixing bath are metal ions such as iron, cobalt and iron that are coordinated with aminopolycarboxylic acids or organic acids such as oxalic acid and citric acid. Typical examples of the aminopolycarboxylic acids are listed below: ethylenediaminetetraacetic acid, diethylenetriaminepentaacetic acid, propylenediaminetetraacetic acid, nitrilotriacetic acid, iminodiacetic acid, ethyl-ether diaminetetraacetic acid, ethylenediaminetetrapropionic acid, ethylenediaminetetraacetic acid disodium salt, diethylenetriaminepentaacetic acid pentasodium salt, and nitrilotriacetic acid sodium salt.

The bleaching bath may contain various additives in addition to the bleaching agents listed above. A bleach-fixing bath that may be employed in the bleaching step will contain a suitable silver halide fixing agent in addition to the bleaching agents. The bleach-fixing bath may further contain a halogen compound such as potassium bromide. As in the case of the bleaching bath, the bleach-fixing bath may also contain various additives such as, for example, pH buffers, brighteners, defoamers, surfactants, preservatives, chelating agents, stabilizers and organic solvents.

Examples of the silver halide fixing agent that are incorporated in the bleach-fixing bath include sodium thiosulfate, ammonium thiosulfate, potassium thiocyanate, sodium thiocyanate, thiourea, thioether, and other compounds that are commonly employed in fixing treatments and which will react with silver halide to form water-soluble silver salts.

In order to ensure rapidity in overall processing, the temperature employed for color-developing and bleach-fixing (or bleaching and fixing in separate steps) the silver halide color photographic material of the present invention, and for performing optional treatments such as rinsing, stabilization and drying is preferably set not lower than 30° C.

The silver halide color photographic material of the present invention may be subjected to a waterless stabilizing step as shown in Unexamined Published Japanese Patent Application Nos. 14834/1983, 105145/1983, 134634/1983 and 18631/1983; and Japanese Patent Application Nos. 2709/1983 and 89288/1984.

The silver halide color photographic material of the present invention is characterized in that the blue-sensitive silver halide emulsion layer contains a highly reactive yellow coupler that has a relative coupling reaction rate of 0.3 or more and that the green-sensitive silver halide emulsion layer contains a pyrazolotriazole-based magenta coupler of Formula (I). Because of these features, the photographic material of the invention can be processed rapidly and in a consistent manner without causing extensive fog, and has good keeping quality while producing a color image having improved light-fastness.

The following examples are provided for the purpose of further illustrating the present invention but are by no means intended as limiting.

EXAMPLE 1

A sample (No. 1) of silver halide color photographic material was prepared by coating successively the following layers, in the order written, on a paper base both sides of which had been laminated with polyethylene.

Layer 1: This layer contained 1.2 g/m$^2$ of gelatin, 0.32 g/m$^2$ (in terms of silver as hereinafter) of a blue-sensitive silver chlorobromide emulsion (with 80 mol% of silver bromide) and 0.80 g/m$^2$ of a yellow coupler (YY-1, see below) dissolved in 0.50 g/m$^2$ of dioctyl phthalate.

Layer 2: An intermediate layer containing 0.7 g/m$^2$ of gelatin, 8 mg/m$^2$ of a water-soluble dye (AI-1, see below) and 4 mg/m$^2$ of another water-soluble dye (AI-2, see below).

Layer 3: This layer contained 1.25 g/m$^2$ of gelatin, 1.80 g/m$^2$ of a green-sensitive silver chlorobromide emulsion (with 7 mol% of silver bromide) and 0.62 g/m$^2$ of a magenta coupler (MM-1, see below) dissolved in 0.30 gm$^2$ of dioctyl phthalate.

Layer 4: An intermediate layer composed of 1.2 g/m$^2$ of gelatin.

Layer 5: This layer contained 1.2 g/m$^2$ of gelatin, 0.30 g/m$^2$ of a red-sensitive silver chlorobromide emulsion (with 70 mol% of silver bromide), and 0.45 g/m$^2$ of a cyan coupler (C-1, see below) dissolved in 0.20 g/m$^2$ of dioctyl phthalate.

Layer 6: This layer contained 1.0 g/m$^2$ of gelatin and 0.30 g/m$^2$ of an ultraviolet absorber (UV-1, see below) dissolved in 0.20 g/m$^2$ of dioctyl phthalate.

Layer 7: This layer contained 0.5 g/m$^2$ of gelatin.

Sample Nos. 2 to 6 were prepared by using the same basic formulation as described above except that the yellow and magenta couplers were changed to those listed in Table 1.

(YY-1)

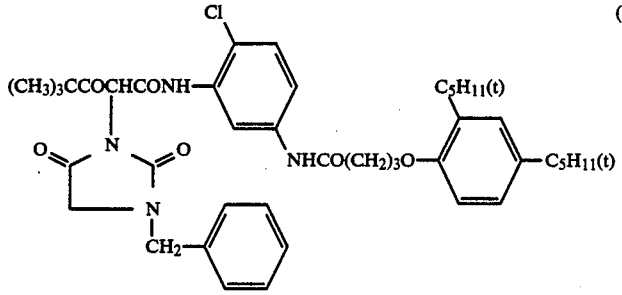

(MM-1)

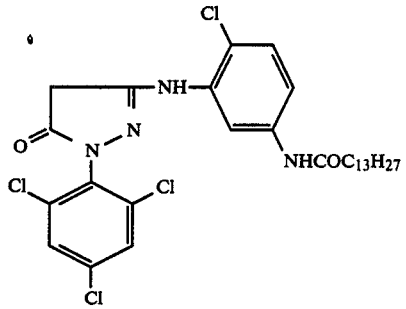

(MM-2)

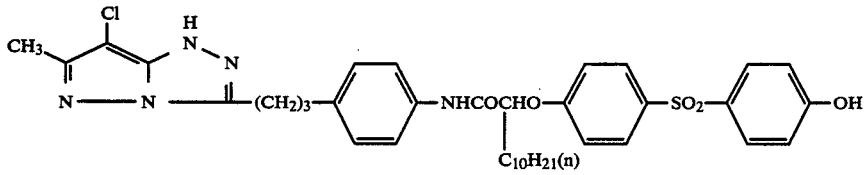

(C-1)

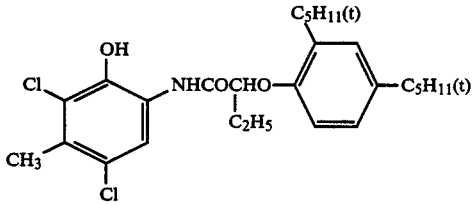

(AI-1)

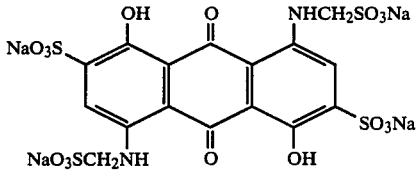

(AI-2)

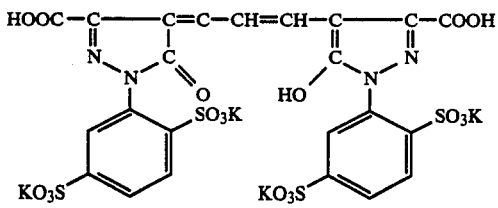

(UV-1)

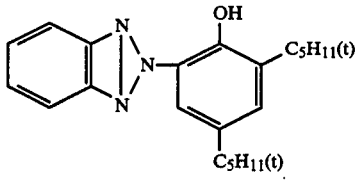

Each of layers 2, 4 and 7 contained 2,4-dichloro-6-hydroxy-S-triazine sodium as a hardener in an amount of 0.017 g per gram of gelatin.

TABLE 1

| Sample No. | Yellow coupler | Magenta coupler | Remarks |
|---|---|---|---|
| 1 | YY-1 | MM-1 | Comparative sample |
| 2 | YY-1 | M-11 | Comparative sample |
| 3 | Y-6 | MM-1 | Comparative sample |
| 4 | Y-6 | MM-2 | Comparative sample |
| 5 | Y-6 | M-11 | Sample of the present invention |
| 6 | Y-22 | M-20 | Sample of the present invention |

Each of sample Nos. 1 to 6 was exposed through an optical wedge and processed by the following scheme.

| Steps | Time |
|---|---|
| Color development (38° C.) | 1 min and 30 sec or 3 min and 30 sec |
| Bleach-fixing (38°) | 1 min and 30 sec |
| Rinsing (38° C.) | 1 min |
| Drying (60–80° C.) | 2 min |

The processing solutions used had the following formulations.

Color developer

| Components | Amount |
|---|---|
| Pure water | 800 ml |
| Benzyl alcohol | 15 ml |
| Hydroxylamine sulfate | 2.0 g |
| Potassium bromide | 1.0 g |
| Sodium chloride | 1.0 g |
| Potassium sulfite | 2.0 g |
| Triethanolamine | 2.0 g |
| N—ethyl-N—β-methanesulfonamidoethyl-3-methyl-4-aminoaniline sulfate | 4.5 g |
| 1-hydroxyethylidene-1,1-diphosphonic acid (60% aq. sol.) | 1.5 ml |
| Potassium carbonate | 32.0 g |
| Whitex BB (50% aq. sol.) (trade name of Sumitomo Chemical Co., Ltd. for brightener) | 2.0 ml |

Pure water was added to make a total of 1,000 ml and the resulting solution was adjusted to a pH of 10.1 with 20% potassium hydroxide or 10% diluted sulfuric acid.

Bleach-fixing solution

| Components | Amount |
|---|---|
| Pure water | 550 ml |
| Ethylenediaminetetraacetic acid iron (III) ammonium salt | 65 g |
| Ammonium thiosulfate | 85 g |
| Sodium hydrogensulfite | 10 g |
| Sodium metabisulfite | 2 g |
| Ethylenediaminetetraacetic acid disodium salt | 20 g |
| Sodium bromide | 10 g |
| Pure water (pH adjusted to 7.0 by addition of ammonia water or dilute sulfuric acid) | to make 1,000 ml |

Each of the processed samples was subjected to sensitometry by routine procedures for evaluating the sensitivity (S), maximum density (Dmax) and fog (Fog) of the blue-sensitive silver halide emulsion and green-sensitive silver halide emulsion in each sample for two different color development times (1 min and 30 sec, and 3 min and 30 seconds). The results are shown in Table 2. The sensitivity data in Table 2 are based on relative values, with the sensitivity for the longer development time (3 min and 30 sec) taken as 100.

TABLE 2

| Sample No. | | Development time: 1 min and 30 sec S | Dmax | Fog | 3 min and 30 sec S | Dmax | Fog |
|---|---|---|---|---|---|---|---|
| 1 | R*1 | 68 | 1.65 | 0.03 | 100 | 2.36 | 0.04 |
| | O*2 | 92 | 2.07 | 0.03 | 100 | 2.20 | 0.04 |
| 2 | R | 69 | 1.61 | 0.04 | 101 | 2.31 | 0.05 |
| | O | 90 | 2.21 | 0.04 | 100 | 2.33 | 0.08 |
| 3 | R | 98 | 2.39 | 0.04 | 101 | 2.47 | 0.09 |
| | O | 93 | 2.08 | 0.03 | 100 | 2.22 | 0.04 |
| 4 | R | 102 | 2.42 | 0.03 | 105 | 2.50 | 0.05 |
| | O | 87 | 2.01 | 0.03 | 98 | 2.41 | 0.06 |
| 5 | R | 97 | 2.36 | 0.03 | 101 | 2.42 | 0.04 |
| | O | 100 | 2.21 | 0.04 | 102 | 2.39 | 0.05 |
| 6 | R | 100 | 2.38 | 0.04 | 102 | 2.47 | 0.05 |
| | O | 100 | 2.35 | 0.04 | 104 | 2.39 | 0.05 |

*1R: Blue-sensitive silver halide emulsion
*2O: Green-sensitive silver halide emulsion.

As the data in Table 2 show, sample Nos. 5 and 6 in accordance with the present invention attained satisfactory photographic performance even when the development time was as short as 1 minute and 30 30 seconds. In addition to this rapidity in development, the three samples could be processed in a consistent manner without causing extensive fog.

EXAMPLE 2

The processed sample Nos. 4 to 6 obtained in Example 1 were exposed to light in a xenon fadeometer for 5 days in order to evaluate the lightfastness of the magenta image formed in each sample. The results are shown in Table 3.

TABLE 3

| Sample No. | Lightfastness (%) | Remarks |
|---|---|---|
| 4 | 48 | Comparative sample |
| 5 | 86 | Sample of the present invention |
| 6 | 89 | Sample of the present invention |

Lightfastness: Percentage of residual dye after testing of lightfastness with an initial density of 1.0.

Table 3 clearly shows that the samples of the present invention produced highly lightfast magenta images.

What is claimed is:

1. A silver halide color photographic material having formed on a base photographic layers including a blue-sensitive silver halide emulsion layer, a green-sensitive silver halide emulsion layer and a red-sensitive silver halide emulsion layer, wherein said blue-sensitive silver halide emulsion layer contains at least one highly reactive yellow coupler having a relative coupling reaction rate of 0.3 or more, said green-sensitive silver halide emulsion layer containing at least one compound of Formula (I):

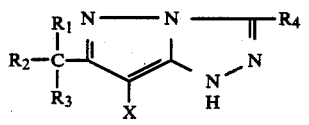

(I)

wherein X is a halogen atom or a monovalent organic group capable of leaving upon coupling reaction with the oxidized product of a developing agent; $R_1$ to $R_3$ which may be the same or different each represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyan group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamido group, an imido group, a ureido group, a sulfamoylamino group, an alkoxycarbonylamino group, an alkoxycarbonylamino group, an aryloxycarbonylamino group, an alkoxycarbonyl group, an aryloxycarbonyl group, an alkylthio group, an arylthio group or a heterocyclic thio group, provided that at least two of $R_1$ to $R_3$ are other than a hydrogen atom; and $R_4$ is a hydrogen atom, an alkyl group, an aryl group, a heterocyclic group, an acylamino group, an alkylamino group, an anilino group, an alkoxycarbonyl group or an alkylthio group.

2. A silver halide color photographic material according to claim 1 wherein said highly reactive yellow coupler has a relative coupling rate of 0.5 or more.

3. A silver halide color photographic material according to claim 1 wherein said highly reactive yellow coupler is present in an amount of $2\times10^{-3}$ to $5\times10^{-1}$ mole per mole of the silver in said blue-sensitive silver halide emulsion layer.

4. A silver halide color photographic material according to claim 1 wherein said compound of Formula (I) is such that $R_1$ to $R_3$ are at least two alkyl groups, X being a halogen atom, and $R_4$ being an alkyl group.

5. A silver halide color photographic material according to claim 1 wherein said compound of Formula (I) is present in an amount of $2\times10^{-3}$ to $5\times10^{-1}$ mole per mole of the silver in said green-sensitive silver halide emulsion layer.

6. A silver halide color photographic material according to claim 1 wherein said highly reactive yellow coupler has a relative coupling rate of 0.5 or more and said compound of Formula (I) is such that $R_1$ to $R_3$ are at least two alkyl groups, X being a halogen atom and $R_4$ being an alkyl group.

7. A silver halide color photographic material according to claim 1 wherein said highly reactive yellow coupler is present in an amount of $2\times10^{-3}$ to $5\times10^{-1}$ mole per mole of the silver in said blue-sensitive silver halide emulsion layer and said compound of Formula (I) being present in an amount of $2\times10^{-3}$ to $5\times10^{-1}$ mole per mole of the silver in said green-sensitive silver halide emulsion layer.

8. A silver halide color photographic material according to claim 1 wherein said highly reactive yellow coupler has a relative coupling rate of 0.5 or more and is present in an amount of $2\times10^{-3}$ to $5\times10^{-1}$ mole per mole of the silver in said blue-sensitive silver halide emulsion layer.

9. A silver halide color photographic material according to claim 1 wherein said compound of Formula (1) is such that $R_1$ to $R_3$ are at least two alkyl groups, X being a halogen atom and $R_4$ being an alkyl group, and said compound of Formula (I) is present in an amount of $2\times10^{-3}$ to $5\times10^{-1}$ mole per mole of the silver in said green-sensitive silver halide emulsion layer.

10. A silver halide color photographic material according to claim 1 wherein said highly reactive yellow coupler has a relative coupling rate of 0.5 or more, said silver halide color photographic material having at least two gelatin layers on the light-sensitive silver halide emulsion layer positioned farthest away from the base, said silver halide color photographic material being intended to be processed by a scheme wherein it is exposed, treated in a color developing bath and, immediately thereafter, bleach-fixed without any intervening rinsing step.

11. A silver halide color photographic material according to claim 1 wherein said green-sensitive silver halide emulsion layer contains said compound of Formula (I) wherein $R_1$ to $R_3$ are at least two alkyl groups, X is a halogen atom and $R_4$ is an alkyl group, said silver halide color photographic material having a silver deposit of 0.4–0.8 g/m$^2$.

12. A silver halide color photographic material according to claim 1 wherein said green-sensitive silver halide emulsion layer contains said compound of Formula (I) wherein $R_1$ to $R_3$ are at least two alkyl groups, X is a halogen atom and $R_4$ is an alkyl group, said compound being present in an amount of $2\times10^{-3}$ to $5\times10^{-1}$ mole per mole of the silver in said green-sensitive silver halide emulsion layer, said silver halide color photographic material having a silver deposit of 0.4–0.8 g/m$^2$.

13. A silver halide color photographic material according to claim 1 wherein said highly reactive yellow coupler has a relative coupling rate of 0.5 or more and is present in an amount of $2\times10^{-3}$ to $5\times10^{-1}$ mole per mole of the silver in said blue-sensitive silver halide emulsion layer, said silver halide color photographic material having at least two gelatin layers on the light-sensitive silver halide emulsion layer positioned farthest away from the base, said silver halide color photographic material being intended to be processed by a scheme wherein it is exposed, treated in a color developing bath and, immediately thereafter, bleach-fixed without any intervening rinsing step.

14. A silver halide color photographic material according to claim 1 wherein said highly reactive yellow coupler has a relative coupling rate of 0.5 or more, said compound of Formula (I) being such that $R_1$ to $R_3$ are at least two alkyl groups, X being a halogen atom, and $R_4$ being an alkyl group, said silver halide color photographic material having a silver deposit of 0.4–0.8 g/m$^2$, said silver halide color photographic material having at least two gelatin layers on the light-sensitive silver halide emulsion layer positioned farthest away from the base, the principal silver halide composition of said silver halide color photographic material being silver chlorobromide or silver chloroiodobromide, said silver halide color photographic material being intended to be processed by a scheme wherein it is exposed, treated in a color developing bath and, immediately thereafter, bleach-fixed without any intervening rinsing step.

* * * * *